US012773642B1

(12) United States Patent
Polo et al.

(10) Patent No.: US 12,773,642 B1
(45) Date of Patent: Oct. 27, 2026

(54) TOY TRACK ASSEMBLY

(71) Applicant: Mattel, Inc., El Segundo, CA (US)

(72) Inventors: Matthew Licea Polo, Redondo Beach, CA (US); Benjamin Donaldson Reading, Marina Del Rey, CA (US); Binh Tieu Phun, El Segundo, CA (US); Jorge Alejandro Lugo Gutierrez, Long Beach, CA (US); Tyler Kenney, Sherman Oaks, CA (US); Christopher R. Colangelo, Van Nuys, CA (US); Simon Poirier-Malo, Los Angeles, CA (US); Daniel Tam, Shen Zhen (CN); Hong Wang, Kowloon (HK); Tom Chen, Shenzhen City (CN); Jie Bai, Shenzhen City (CN); Weizhi Zeng, Shenzhen City (CN)

(73) Assignee: MATTEL, INC., El Segundo, CA (US)

( * ) Notice: Subject to any disclaimer, the term of this patent is extended or adjusted under 35 U.S.C. 154(b) by 0 days.

(21) Appl. No.: 19/444,765

(22) Filed: Jan. 9, 2026

Related U.S. Application Data

(63) Continuation of application No. 19/386,975, filed on Nov. 12, 2025, now abandoned.

(51) Int. Cl.

| | |
|---|---|
| ***A63H 18/02*** | (2006.01) |
| ***A63H 18/08*** | (2006.01) |
| ***A63H 19/30*** | (2006.01) |

(52) U.S. Cl.
CPC ..... *A63H 18/02* (2013.01); *A63H 18/08* (2013.01); *A63H 19/30* (2013.01)

(58) Field of Classification Search
CPC ..... A63H 18/08; A63H 19/30; A63H 18/02; A63H 18/00; B61K 5/06
USPC ..... 238/10 E, 10 B, 10 F, 10 R, 10 A; 104/DIG. 1
See application file for complete search history.

(56) References Cited

U.S. PATENT DOCUMENTS

| | | | | |
|---|---|---|---|---|
| 2,590,317 A * | 3/1952 | Henderson | A63H 19/30 | 104/264 |
| 5,141,469 A * | 8/1992 | Satake | A63H 30/04 | 446/431 |
| D344,307 S * | 2/1994 | Ruszkai | D21/565 | |
| 5,297,484 A * | 3/1994 | Piserchia | A63H 19/00 | 446/446 |

(Continued)

FOREIGN PATENT DOCUMENTS

WO 2019006112 A1 1/2019

*Primary Examiner* — Zachary L Kuhfuss
(74) *Attorney, Agent, or Firm* — Edell, Shapiro & Finnan, LLC

(57) ABSTRACT

A track of a toy track assembly includes a wheel channel configured to receive a wheel of a toy vehicle and a rail configured to encourage the wheel of the toy vehicle to remain within the wheel channel. The track includes rerailing features to maintain proper travel of a toy vehicle along the toy track assembly. The rerailing features include an outer groove extending from an exterior surface of the rail toward the wheel channel to guide the wheel from the exterior surface of the rail into the wheel channel. Additionally or alternatively, the rerailing features include a deflector with a surface configured to guide the wheel of the toy vehicle from an interior side of the wheel channel into the wheel channel.

20 Claims, 18 Drawing Sheets

(56) References Cited

U.S. PATENT DOCUMENTS

| | | | | |
|---|---|---|---|---|
| 5,503,330 | A * | 4/1996 | Riley | A63H 19/30 238/10 E |
| 5,657,695 | A * | 8/1997 | Lanoix | A63H 18/02 104/126 |
| 5,690,278 | A | 11/1997 | Grubb | |
| 6,883,719 | B2 | 4/2005 | Pyrce | |
| 7,111,560 | B1 * | 9/2006 | Frost | A63H 19/30 238/10 R |
| 7,938,068 | B2 * | 5/2011 | Parker | A63H 19/34 104/53 |
| 9,061,218 | B2 | 6/2015 | DiBartolo et al. | |
| 10,035,075 | B2 * | 7/2018 | Chantrell | A63H 19/30 |
| 2013/0126628 | A1 * | 5/2013 | DiBartolo | A63H 18/08 238/10 A |
| 2015/0283472 | A1 * | 10/2015 | Chantrell | A63H 19/30 238/10 F |
| 2016/0121230 | A1 * | 5/2016 | Muldoon | A63H 19/36 238/10 E |
| 2023/0111261 | A1 * | 4/2023 | Helinski | A63H 18/02 446/116 |

* cited by examiner

TOY TRACK ASSEMBLY

CROSS-REFERENCE TO RELATED APPLICATIONS

The patent application is a continuation of U.S. patent application Ser. No. 19/386,975, entitled "Toy Track Assembly," filed Nov. 12, 2025, and hereby incorporated by reference in its entirety for all purposes.

TECHNICAL FIELD

The present disclosure relates to a toy track assembly and, specifically, to a toy track assembly that includes rerailing and coupling features that improve the play value of the toy track assembly.

BACKGROUND

A toy track assembly includes one or more sections of track coupled together to form a pathway along which a toy vehicle can travel. In some instances, the track may include one or more channels or rails that help guide the toy vehicle along the track (e.g., from one track section to a next track section). However, young children often have difficulty placing the toy vehicle correctly on the toy vehicle track and may position the toy vehicle in a way such that one or more wheels of the toy vehicle are outside the confines of the channels or rails. During play, the toy vehicle can also be accidentally displaced and move off the track, resulting in one or more wheels of the toy vehicle moving exteriorly or interiorly of the channel. These instances, where the wheels of a toy vehicle are misaligned on a track, are undesirable and impair the ability of the toy vehicle to move smoothly along the track. Accordingly, there is a need for a toy track assembly that is able to help realign toy vehicles that are incorrectly positioned on its tracks. Additionally, young children may have difficulty coupling and/or decoupling individual track sections to form a pathway. However, it is also important that the track sections do not decouple too easily during play. Thus, there is also a need for a toy track assembly with track sections that can be easily and securely coupled/decoupled without requiring excessive force.

SUMMARY

A toy track is disclosed herein. The toy track may be provided as a part of a toy track assembly or independently from other components.

In some embodiments, a toy track assembly is provided. The toy track assembly includes a track with a wheel channel, a rail, and an outer groove. The wheel channel extends along a length of the track and is configured to receive a wheel of a toy vehicle to direct the toy vehicle along the length of the track. The rail extends along an exterior edge of the wheel channel and is configured to encourage the wheel of the toy vehicle to remain within the wheel channel. The outer groove extends transversely from an exterior surface of the rail toward the wheel channel to guide the wheel of the toy vehicle from the exterior surface of the rail into the wheel channel if the wheel is exterior to the exterior surface of the rail. Thus, the track automatically realigns/rerails a displaced/derailed toy vehicle (e.g., a toy train vehicle) so that play can continue without user intervention.

In some embodiments, the track also includes a deflector disposed interiorly of an interior side of the wheel channel. The surface of the deflector is configured to guide the wheel of the toy vehicle from the interior side of the wheel channel into the wheel channel if the wheel is interior of the interior side of the wheel channel. Thus, the track can rerail a toy vehicle regardless of the direction in which the toy vehicle leaves the track.

Still further, the track of the toy track assembly includes an end with an extension, and the toy track assembly comprises an additional track having a recess configured to receive the extension to couple the track and the additional track to one another. In some instances, the extension of the track comprises a first tooth forming a first detent mechanism and the additional track comprises a second tooth forming a second detent mechanism. The first detent mechanism is configured to interface with the second detent mechanism to couple the track and the additional track to one another. This provides a secure connection between extensions and recesses to ensure that tracks of the toy track assemblies do not disconnect accidentally during play.

Additionally or alternatively, the end of the track may include a tab extending outwardly away from the rail. The tab is configured to deflect the wheel into the groove if the wheel is exterior to the exterior surface of the rail. In some embodiments, the toy track assembly further includes a support configured to receive the tab to couple the track and the support to one another. This tab helps form a secure connection between the track and the support, which ensures that the toy track assembly can securely provide changes in elevation that are often found to be interesting during play.

In some embodiments, a track for a toy assembly is provided. The track includes a channel, a rail, and a groove. The channel is configured to receive a wheel of a toy vehicle of the toy assembly to direct the toy vehicle along a length of the track. The rail comprises an interior surface facing the channel and an exterior surface facing away from the channel. The groove extends transversely from the exterior surface of the rail to the interior surface of the rail toward the channel. The groove is configured to direct a toy vehicle wheel back into the channel if the wheel is exterior to the exterior surface of the rail. Thus, the track can automatically rerail a derailed toy vehicle (e.g., a toy train vehicle) so that play can continue without user intervention. This uninterrupted play increases the play value of the toy track assembly.

In some embodiments, a track for a toy assembly is provided. The track includes a channel, a rail, a groove, and a deflector. The channel is configured to receive a wheel of a toy vehicle to direct the toy vehicle along a length of the track. The rail extends along an exterior side of the channel and is configured to encourage the wheel of the toy vehicle to remain within the channel. The groove extends through the rail to direct the wheel of the toy vehicle back into the channel if the wheel is exterior to the rail. The deflector is disposed interiorly of an interior side of the wheel channel and configured to guide the wheel of the toy vehicle back into the channel if the wheel is interior to the channel. Thus, the track can automatically rerail a derailed toy vehicle (e.g., a toy train vehicle) so that play can continue without user intervention. This uninterrupted play increases the play value of the toy track assembly.

DETAILED DESCRIPTION

The present disclosure is directed to a toy track assembly. The toy track assembly includes features to help rerail a toy vehicle onto a track, insofar as the term "rerail" is used herein to denote a process that moves and/or repositions a toy vehicle wheel back to or towards its intended wheel path. In one exemplary embodiment, the track includes a wheel channel configured to direct a toy vehicle along a length of the track, a rail configured to encourage the wheel to remain within the wheel channel, and a groove extending transversely from an exterior surface of the rail toward the wheel channel to direct the wheel of the toy vehicle back into the wheel channel if the wheel is exterior to the exterior surface of the rail. The groove is configured to rerail the wheel into the wheel channel, through and/or over the rail. Additionally, or alternatively, the track includes a deflector disposed interiorly of an interior side of the wheel channel. The deflector generally extends toward the wheel channel to guide the wheel of the toy vehicle back into the wheel channel if the wheel is interior to the wheel channel. The deflector is also configured to rerail the wheel into a wheel channel, through and/or over a rail. Rerailing the toy vehicle enables the toy vehicle to travel continuously along the toy track assembly, which enhances an entertainment value and/or play experience with the toy vehicle, in part because it reduces the number of times a user will need to "fix" or realign the toy vehicle during play.

Figure 1A:
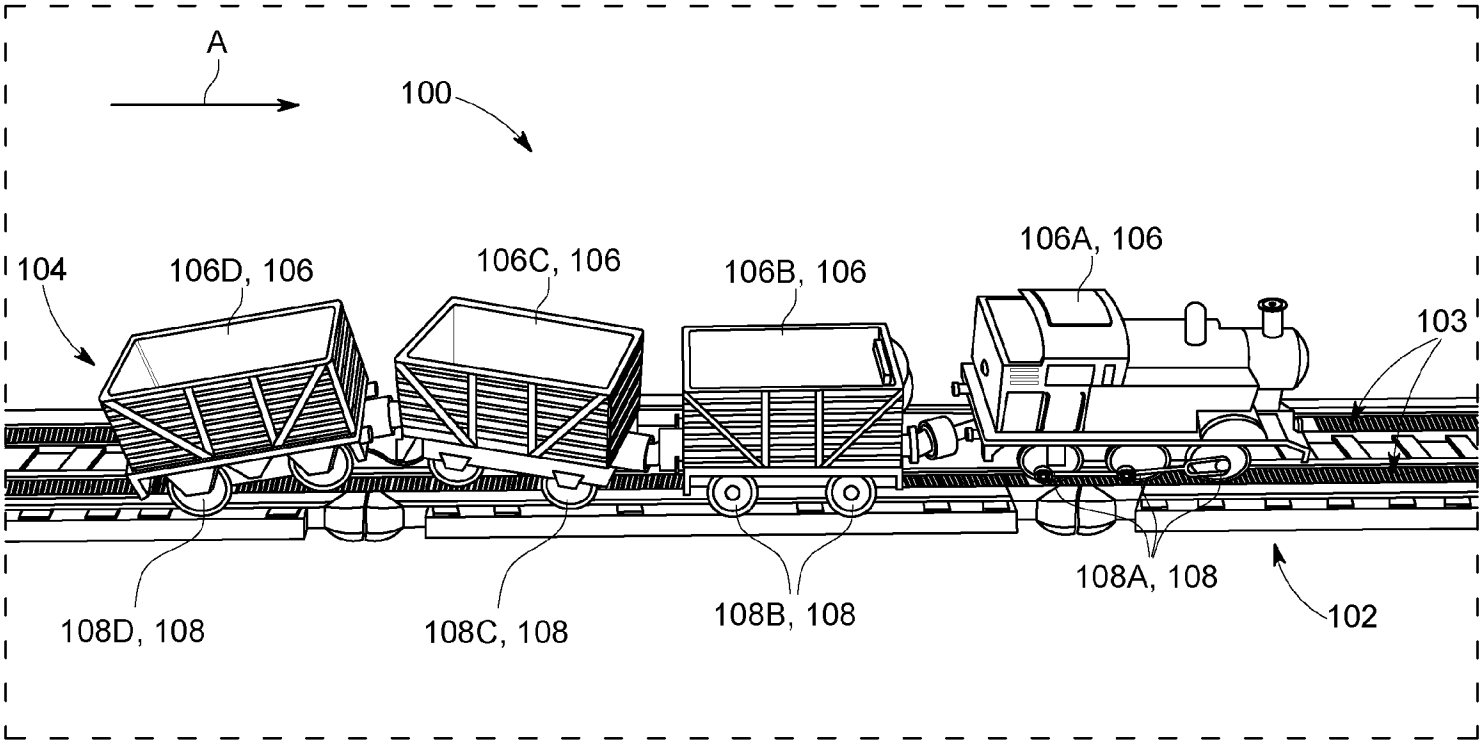
FIG. 1A illustrates a perspective view of a toy vehicle system in which a toy vehicle is at least partially derailed from a toy track, in accordance with an embodiment of the present application.

FIG. 1A illustrates an embodiment of a toy vehicle system 100 with a toy track assembly 102 and a toy vehicle 104. In this embodiment, the toy vehicle 104 has the appearance of a train, and the toy track assembly 102 has the appearance of a railroad. The toy vehicle 104 includes multiple toy cars 106 coupled to one another and each toy car 106 includes a plurality of wheels 108 configured to travel along the toy track assembly 102. Meanwhile, the toy track assembly 102 has rails and rail ties to resemble a railroad track. The toy track assembly 102 also includes wheel channels 103 configured to receive each wheel 108 and direct each wheel 108 along a length A of the toy track assembly 102. In other embodiments, the toy track assembly 102 and/or a toy vehicle 104 may be based on other themes, such as a racetrack and a racecar.

In FIG. 1A, the illustrated toy vehicle 104 is partially derailed. A first set of wheels 108A of a first toy car 106A of the toy vehicle 104 are properly engaged with the toy track assembly 102 (e.g., positioned within the wheel channels 103). Thus, the first toy car 106A is able to travel smoothly along the toy track assembly 102. However, a second set of wheels 108B of a second toy car 106B, a third wheel 108C of a third toy car 106C, and a fourth wheel 108D of a fourth toy car 106D are not properly aligned and engaged with the toy track assembly 102. Specifically, the second set of wheels 108B, the third wheel 108C, and the fourth wheel 108D are positioned exteriorly of the wheel channel 103. Consequently, the second toy car 106B, the third toy car 106C, and the fourth toy car 106D are unable to travel smoothly along the toy track assembly 102 and may cause the entire toy vehicle 104 to derail and fall off the toy track assembly 102.

Figure 1B:
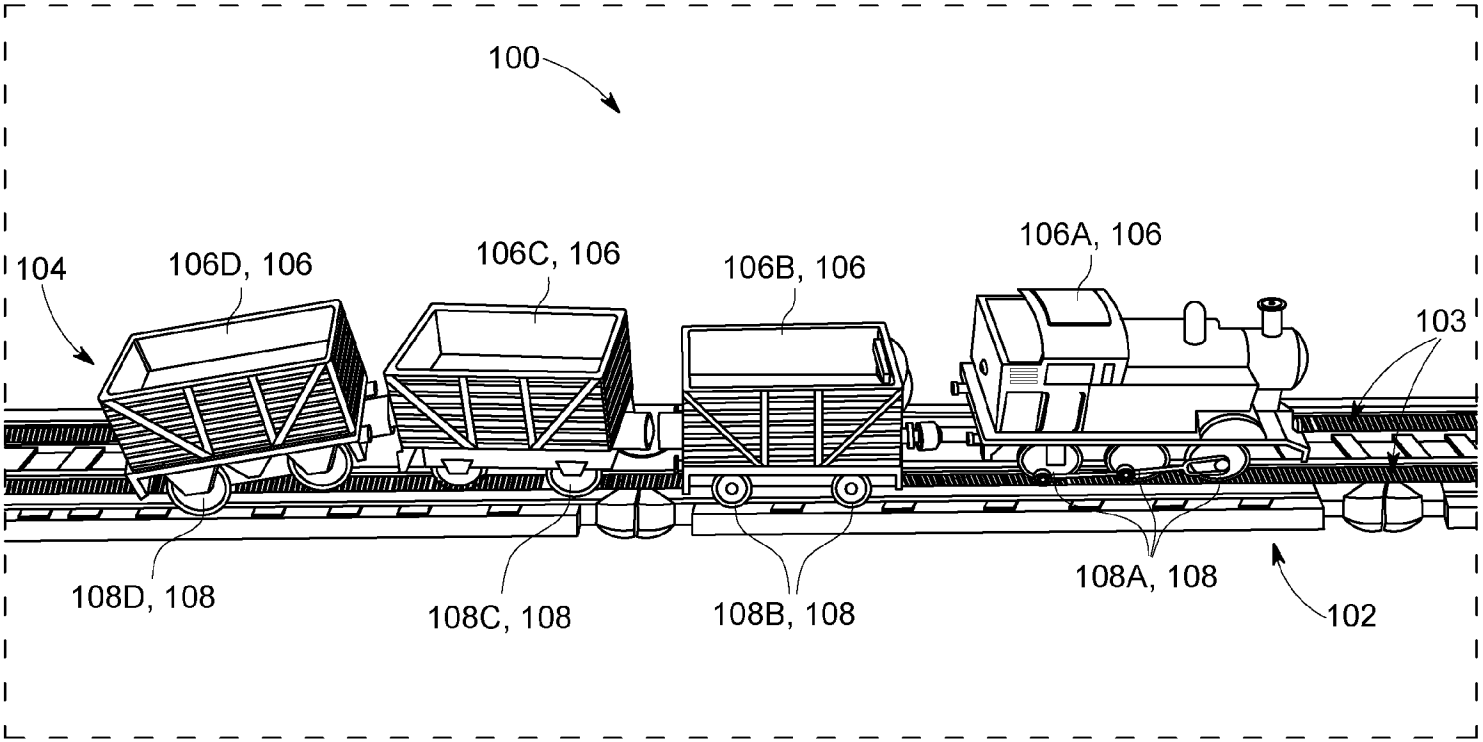
FIG. 1B illustrates a perspective view of the toy vehicle system of FIG. 1A with the toy vehicle at least partially rerailed onto the toy track, in accordance with an embodiment of the present application.

As will be discussed in further detail herein, the toy track assembly 102 is configured to rerail the toy vehicle 104. FIG. 1B illustrates the toy vehicle system 100 after the second toy car 106B and third toy car 106C have been rerailed. More specifically, the toy track assembly 102 is configured to realign the second set of wheels 108B of the first toy car 106B and the third wheel 108C of the third toy car 106C back into the wheel channel 103. Meanwhile, the first toy car 106A remains properly engaged with the toy track assembly 102. Thus, the toy track assembly 102 is configured to rerail toy cars that have been derailed (e.g., toy cars 106B and 106C) while maintaining other toy cars (e.g., the first toy car 106A) within the wheel channels 103.

Figure 1C:
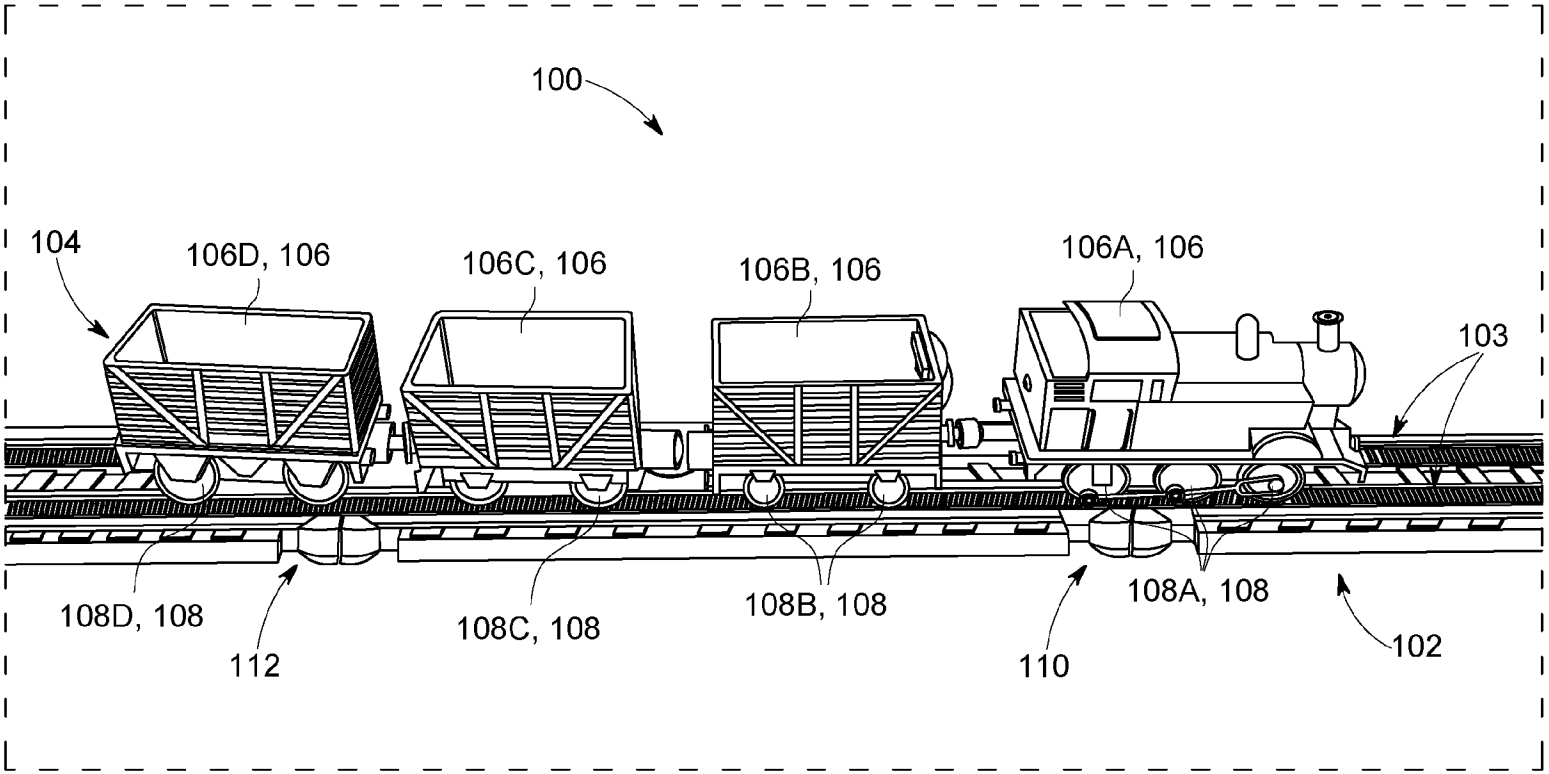
FIG. 1C illustrates a perspective view of the toy vehicle system of FIGS. 1A and 1B with the toy vehicle fully rerailed onto the toy track, in accordance with an embodiment of the present application.

FIG. 1C is a perspective view of the toy vehicle system 100 with the toy vehicle 104 fully rerailed. That is, each toy car 106A-106D of the toy vehicle 104 is properly engaged with the toy track assembly 102. In at least some embodiments, a feature of the toy track assembly 102 includes multiple rerailing points (e.g., positions 110, 112) which allow wheels 108B and 108C to be rerailed at a position 112 along the toy track assembly 102 and the fourth wheel 108D to be rerailed at a second position (not shown) along the toy track assembly 102. Consequently, the toy vehicle 104 can be quickly rerailed, e.g., with different portions or cars of the toy vehicle 104 being rerailed simultaneously or in close time proximity to one another.

Figure 2:
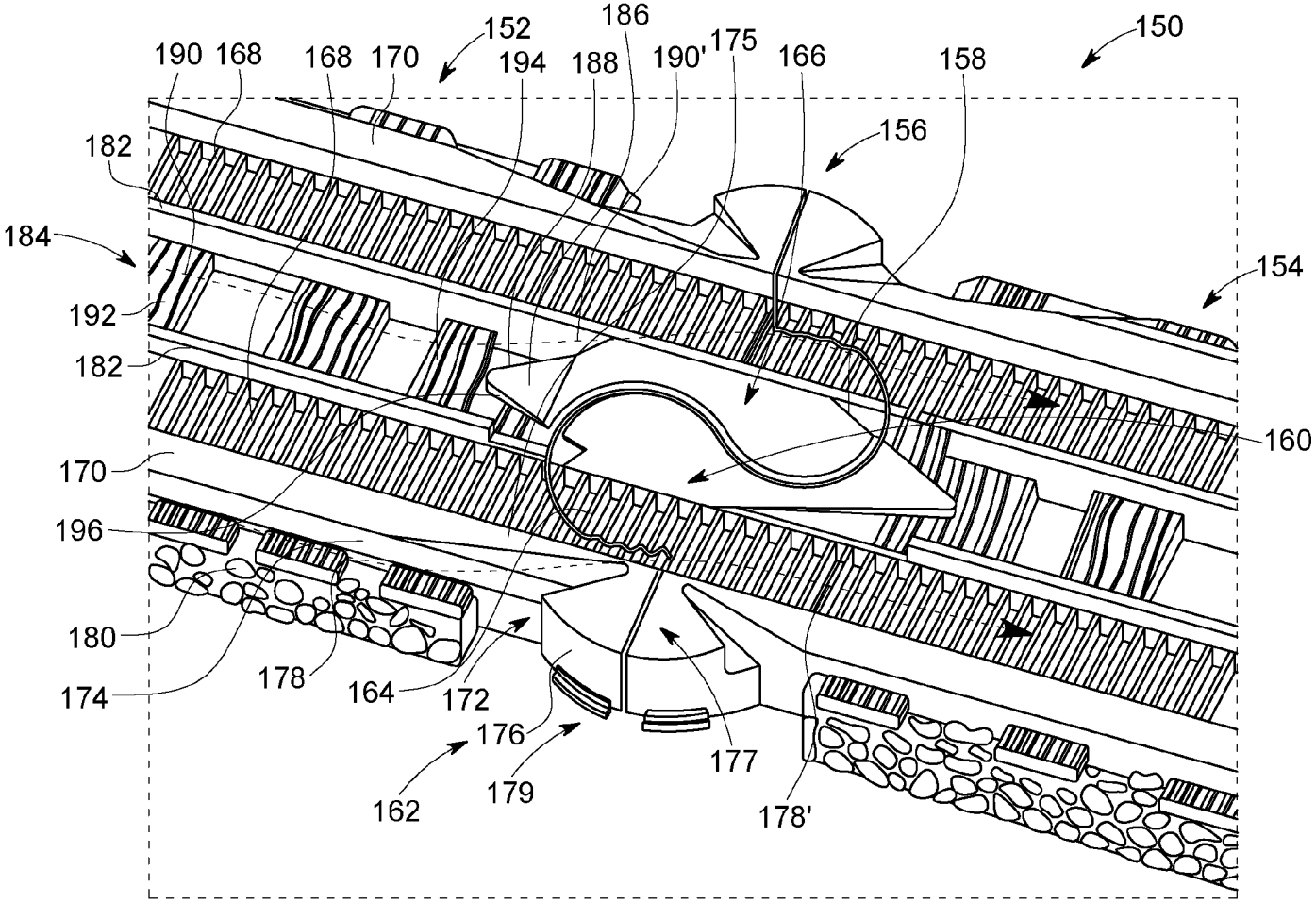
FIG. 2 illustrates a top perspective view of a toy track assembly having two track pieces coupled to one another, in accordance with an embodiment of the present application.

FIG. 2 is a top perspective view of a toy track assembly 150 with a first track 152 (e.g., a first track piece) and a second track 154 (e.g., a second track piece) coupled to one another. In particular, a first end 156 of the first track 152 may include a first extension 158 and a first recess 160, and a second end 162 of the second track 154 may include a second extension 164 and a second recess 166. The first recess 160 is configured to receive the second extension 164, and the second recess 166 is configured to receive the first extension 158 to couple the tracks 152, 154 to one another. The tracks 152, 154 may include additional features, as further discussed herein, to secure the tracks 152, 154 to one another. Additionally or alternatively, the tracks include extensions and recesses that are shaped differently than those depicted in FIG. 2, while still leveraging the rerailing features described herein.

Each track 152, 154 includes wheel channels 168 extending along a length thereof. Respective wheel channels 168 of the tracks 152, 154 are configured to align with one another while the tracks 152, 154 are coupled to one another. Each wheel channel 168 is configured to receive a wheel (e.g., one of the wheels 108) of a toy vehicle (e.g., one of the toy cars 106). Each track 152, 154 also includes rails 170 that extend along respective exterior sides/edges of each wheel channel 168 to encourage the wheels of the toy vehicle to remain within the wheel channels 168. For instance, each rail 170 may be configured to deflect the wheel inwardly to try to block the wheel from moving out of its wheel channel 168. In certain embodiments, each rail 170 is tapered and sloped toward the wheel channels 168 to help position the wheels into the wheel channels 168 (e.g., to guide the wheels into the wheel channels 168), further encouraging the wheels to remain within the wheel channels 168.

In some situations typical with younger children, a child may incorrectly place the toy vehicle on one of the tracks 152, 154 such that one or more wheels of the toy vehicle are positioned outside the wheel channel 168. In other situations, one or more wheels of the toy vehicle may move out of its wheel channel 168 during play (e.g., by jumping over or rolling across the rail 170), thereby causing the toy vehicle to derail from the toy track assembly 150. The toy track assembly 150 of the present application is configured to rerail the toy vehicle. By way of example, each track 152, 154 includes outer grooves 172 that each extend transversely from an exterior surface 174 of a rail 170 to an interior surface 175 of the rail 170. Thus, each outer groove 172 is configured to guide the wheel from the exterior surface 174 of the rail 170 into the wheel channel 168 if the wheel is positioned exteriorly to the exterior surface 174. In fact, in the depicted embodiment, the rail 170 tapers in synchronization with the outer groove 172 so that the outer groove 172 and rail 170 define a pathway (e.g., a ramped pathway) across the rail 170 that, from certain perspectives, is bounded on one side by the rail 170.

Additionally, each track 152, 154 includes tabs 176 that extend outwardly away from a corresponding rail 170 beyond the exterior surface 174 such that each outer groove 172 extends between a rail 170 and a tab 176. The shape of tab 176 is a circular sector where one side 177 of the tab 176 is generally flat/straight and perpendicular to the wheel channel 168, and a second side 179 of the tab 176 is curved. The tabs 176 from respective tracks 152, 154 are positioned such that when the tracks 152, 154 are coupled together, the respective flat sides 177 of tabs 176 abut one another and the respective curved sides 179 of the tabs 176 form a semicircular shape. The abutment of the flat sides 177 of the tabs 176 reduces any unwanted twisting of the tracks 152, 154 and helps keep the tracks 152, 154 coupled to one another.

In the depicted embodiment, each tab 176 bounds a side of an outer groove 172 (e.g., a side opposite the side bounded by a tapered portion of rail 170) so that each tab 176 is configured to deflect the wheel into a corresponding outer groove 172. Consequently, the outer groove 172 and the tab 176 cooperatively direct the wheel into the wheel channel 168 to rerail the toy vehicle. As an example, a wheel traveling exterior to the exterior surface 174 of the rail 170 may travel along a first direction 178 until it moves into outer groove 172 and is rerailed into the wheel channel 168, as shown by path 178'. In the depicted embodiment, the wheel initially travels along an exterior path 180 (e.g., representing a surface, such the ground and/or a track ballast, on which a railroad is built) extending exterior of the exterior surface 174, into an outer groove 172 (e.g., upon deflecting off a tab 176), and into the wheel channel 168 to be rerailed. In other embodiments, however, the wheel need not travel on a surface when positioned exteriorly of rail 170 (e.g., the wheel may be floating) and may still be rerailed along path 178' via the outer groove 172. Still further, in the depicted embodiment, the outer groove 172 may be ramped or inclined to go up and over the rail 170, but in other embodiments, the outer groove 172 need not be ramped as shown and can go through or over the rail 170 in any desirable manner. That said, in some instances, a ramped outer groove 172 may be advantageous because a derailed wheel may be positioned lower than the wheel channel 168 and may need to be raised back to the wheel channel 168 during a rerailing process.

A wheel of a car may also be derailed interiorly such that the wheel travels between wheel channels 168 of one of the tracks 152, 154. In some embodiments, each track 152, 154 includes walls 182 that each extend along an interior side/edge of a corresponding wheel channel 168. The walls 182 cooperate with the rails 170 to maintain the wheels of the toy vehicle within the wheel channel 168 and, in at least some embodiments, have dimensions and shaping similar to rails 170. The walls 182 further form a space 184 therebetween into which an interiorly derailed wheel may move. Consequently, a derailed wheel may travel along the toy track assembly 150 between the walls 182. To remedy this, each track 152, 154 also includes a deflector 186 positioned interiorly of the interior side of the wheel channels 168 between the walls 182.

In the depicted embodiment, the deflector 186 includes a first surface 188 extending transversely relative to the walls 182 and a second surface 196 that also extends transversely to the walls 182, but in an opposite direction to the first surface 188. Thus, the first surface 188 and the second surface 196 can each guide a wheel from between the walls 182 outward into one of the wheel channels 168. For example, a wheel traveling interiorly of the interior side of the wheel channel 168 in a second direction 190 may be rerailed along a path 190' into a wheel channel 168. Specifically, if a toy vehicle's wheel initially travels in the second direction 190 along an interior path 192 (e.g., representing railroad ties) between the first surface 188 of the deflector 186 and the wall 182 facing the first surface 188, the wheel will be rerailed into the wheel channel 168 defined by that specific wall 182. Similarly, if a toy vehicle's wheel initially travels in the second direction 190 along an interior path 192 (e.g., representing railroad ties) between the second surface 196 of the deflector 186 and the wall 182 facing the second surface 196, the wheel will be rerailed into the wheel channel 168 defined by that specific wall 182. The deflector may be a solid section similar to deflector 186 or comprise of walls that provide the first and second surfaces 188, 196 (as shown for example in FIG. 3).

In certain embodiments, the toy track assembly 150 includes a ramp 194 extending toward the deflector 186 to guide the wheel toward the first surface 188. The deflector 186 is positioned to define two paths along the ramp 194; one into each of the wheel channels 168 of the track piece. Each path includes similar features to those included in a wheel channel 168, such as rack-style teeth with which pinion-style wheels of a toy vehicle may interact to drive along, and each path moves through a gap or break in a respective wall 182 of the track piece. Thus, a toy vehicle wheel traveling along one of the paths is able to move seamlessly back into a wheel channel 168 during a rerailing process. In other embodiments, however, the walls 182 need not include gaps or breaks and ramp 194 guides toy vehicles up and over the walls 182 during a rerailing. Regardless, the ramp 194 is inclined (e.g., like the outer groove 172), which is advantageous because a derailed wheel may be positioned lower than the wheel channel 168 and needs to be raised back to the wheel channel 168 during a rerailing process.

Still referring to FIG. 2, in the depicted embodiment, the first direction 178 and the second direction 190 are substantially parallel to one another. Likewise, the path 178' and the path 190' depicted in FIG. 2 are substantially parallel to one another and rerail different wheels to different wheel channels 168 on the same track 152. This is helpful because toy vehicles often have two wheels on a shared axle that derail from respective wheel channels 168 in the same direction at the same time. The direction, however, is not predetermined, and toy vehicles can regularly derail in either direction (e.g., left or right). Thus, the tracks 152, 154 are configured to rerail a toy vehicle that has derailed in either direction.

More specifically, as mentioned above, a second surface 196 of the deflector 186 can rerail an interiorly derailed wheel onto a wheel channel 168 along a rerailing path that is a mirror image of the path 190'. Similarly, an outer groove 172 on a second side of the track (not labeled) can extend transversely into a second wheel channel 168 to guide the wheel into that wheel channel 168 along a rerailing path that is a mirror image of the path 178'. Put another way, tracks 152, 154 include an interior rerailing feature (e.g., a surface of a deflector) and an exterior rerailing feature (e.g., outer groove 172) for each wheel channel 168 included thereon. Accordingly, the toy track assembly 150 is configured to rerail the toy vehicle regardless of whether the wheels of the toy vehicle are exterior to or interior to the wheel channels 168. In other embodiments, however, certain wheel channels 168 might only include one rerailing feature (e.g., to accommodate other track features and/or if the track includes additional features or structure that prevent derailing in a certain direction).

Each track 152, 154 in a toy track assembly of the present application includes the rerailing features discussed herein (e.g., the outer grooves 172, the deflectors 186, the tabs 176). In fact, a single track 152, 154 includes these rerailing features at each end of the track piece; the rerailing features are associated with each connector included on a piece of track 152, 154. This is illustrated in FIG. 2 with the first end 156 of the first track 152 being coupled to the second end 162 of the second track 154.

Notably, when the first end 156 is coupled to the second end 162, the rerailing features do not face the same direction; the rerailing features are oriented in opposite directions. Thus, when the two tracks 152, 154 are coupled together, the rerailing features are arranged to guide wheels traveling in either direction along the toy track assembly 150 into corresponding wheel channels 168. That is, each coupling between two track pieces, such as between tracks 152, 154, is configured to rerail a toy vehicle regardless of the arrangement of the toy track assembly 150 (e.g., a coupling of various track embodiments) and/or a placement or orientation of the toy vehicle on the toy track assembly 150 (e.g., a location of the toy vehicle on a particular track). Moreover, since the rerailing features for both directions of travel are located at any coupling formed between track pieces of the present application, the rerailing features will be present at regular intervals around a track assembly formed with track pieces of the present application (e.g., because the track assembly is a modular assembly). This improves the operation of the toy track assembly because derailed toy vehicles will be quickly rerailed before traveling a substantial distance while derailed.

That all said, while the rerailing features are arranged at the ends 156, 162 of the tracks 152, 154 in the illustrated embodiment (e.g., the deflectors 186 extend around one of the recesses 160, 166 and/or to one of the extensions 158, 164, the tabs 176 extend from one of the extensions 158, 164 and/or from one of the recesses 160, 166), rerailing features may additionally or alternatively be disposed at other locations of the tracks 152, 154. For example, one of the tracks 152, 154 may include similar rerailing features (e.g., an outer groove 172, a deflector 186, a tab 176) in a middle portion that is not configured to couple to another track. Such rerailing features rerail the toy vehicle while the toy vehicle is traveling along the middle portion (e.g., and not transitioning between tracks). Therefore, any part of the tracks 152, 154 may be configured to rerail a toy vehicle. Indeed, in some instances, it may be preferable to move the rerailing features away from the track couplings because the non-connector portions may be smoother than portions of the track formed by the couplers of the two track pieces.

Figure 3:
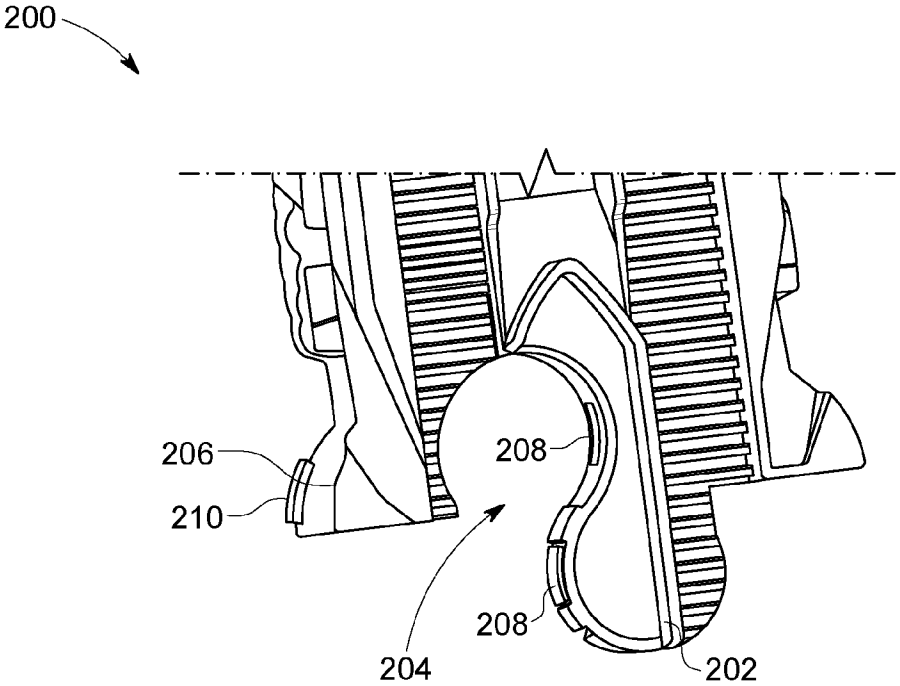
FIG. 3 illustrates a top perspective view of a portion of a track piece, in accordance with an embodiment of the present application.

The tracks of the present application further include a myriad of features that ensure the tracks can be securely connected together and provide a smooth surface along which rerailing can be successfully completed. FIG. 3 illustrates features that allow each track to securely couple to another track and/or another component of a toy vehicle system. FIG. 3 is a top perspective view of a portion of a track 200 (e.g., similar to track 152, 154). The track 200 includes a coupler with an extension 202 and a recess 204 for coupling to another track, as well as tabs 206 that extend laterally away from the sides of the track 200. The track 200 is configured to secure to another track via a detent mechanism. In particular, the track 200 includes a first set of teeth 208 extending from the extension 202 and/or within the recess 204. The first set of teeth 208 is configured to engage with (e.g., latch onto) corresponding teeth of another track to secure the track 200 to the other track, such as to retain the extension of the other track within the recess 204 of the track 200 and/or to retain the extension 202 of the track 200 within the recess of the other track. Additionally, the track 200 includes a second set of teeth 210 extending from the tab 206 to secure the track 200 to another component, such as a support, a prop, and/or a wall, of the toy vehicle system. By way of example, the second set of teeth 210 may be configured to engage with (e.g., latch onto) corresponding teeth of the other component to secure the tab 206 to the other component.

Figure 4:
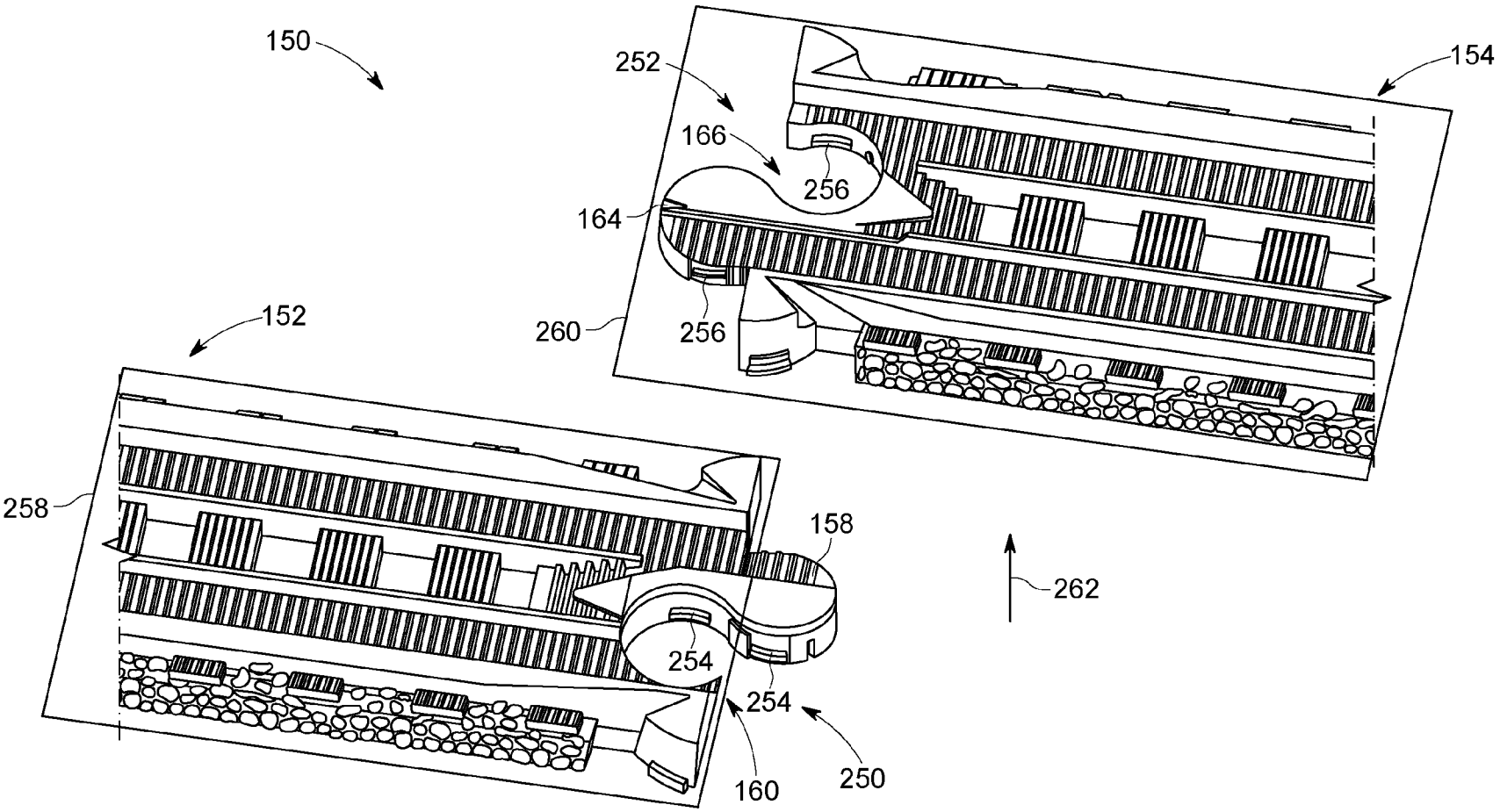
FIG. 4 illustrates a top perspective view of the track pieces of FIG. 2 decoupled from one another.

The features shown in FIG. 3 are employed by the tracks 152, 154 and enable the tracks 152, 154 to be easily and securely coupled to one another to form a smooth connected surface along which a toy vehicle may travel, both while traveling properly within wheel channel 168 and during a rerailing process. FIG. 4 is a top perspective view of the toy track assembly 150 in which the tracks 152, 154 are decoupled from one another. The first track 152 includes a first detent mechanism 250 configured to interface with a second detent mechanism 252 of the second track 154 to couple the tracks 152, 154 to one another. In particular, the first detent mechanism 250 includes a first set of teeth 254 (e.g., extending from the first extension 158, extending within the first recess 160), and the second detent mechanism 252 includes a second set of teeth 256 (e.g., extending from the second extension 164, extending within the second recess 166). A tooth of the first set of teeth 254 is configured to engage with (e.g., latch onto) a corresponding tooth of the second set of teeth 256 to couple the tracks 152, 154 to one another, such as to retain the first extension 158 of the first track 152 in the second recess 166 of the second track 154 and/or to retain the second extension 164 of the second track 154 in the first recess 160 of the first track 152.

The detent mechanisms 250, 252 enable the tracks 152, 154 to be easily coupled together. In certain embodiments, the detent mechanisms 250, 252 enable the tracks 152, 154 to be coupled to one another without having to move the tracks 152, 154 along the same plane. In one instance, the first track 152 extends along a first plane 258 and the second track 154 extends along a second plane 260. The tracks 152, 154 are coupled together when they are moved toward one another along an axis 262 (e.g., a vertical axis) extending transverse to, such as perpendicular to, each of the planes 258, 260. Such a coupling technique is also known as "top-down" coupling, in which a top of one of the tracks 152, 154 is moved toward a bottom of the other of the tracks 152, 154 to bring the planes 258, 260 into planar alignment. Thus, the tracks 152, 154 are moved and coupled to one another without having the planes 258, 260 be coplanar throughout the coupling process. A similar decoupling technique is also be used to decouple and separate the tracks 152, 154 from one another in which the tracks 152, 154 are moved (e.g., along the axis 262) in directions to bring the planes 258, 260 out of planar alignment. This coupling and decoupling technique is more easily performed than, for instance, an alternative technique in which tracks are moved while in planar alignment for coupling/decoupling.

Figure 5A:
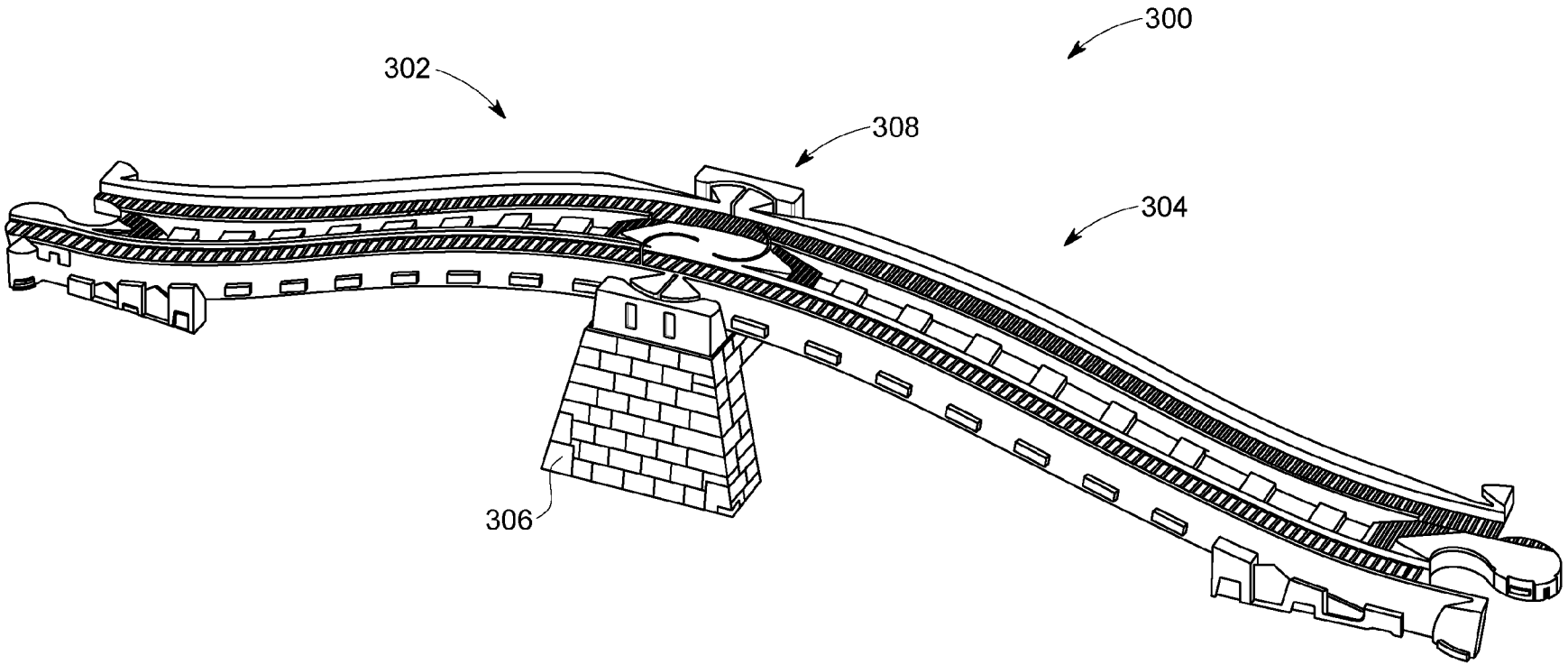
FIG. 5A illustrates a perspective view of a toy track assembly with track pieces coupled to a support, in accordance with an embodiment of the present application.

As mentioned, tracks are configured to couple to other components. FIG. 5A is a perspective view of a toy track assembly 300 that includes a first ramped track 302, a second ramped track 304, and a support 306 (e.g., a stanchion) coupled to one another. The toy track assembly 300 allows a toy vehicle to ascend and descend the toy track assembly 300. Each of the ramped tracks 302, 304 includes features (e.g., a wheel channel, a rail, an outer groove, a tab, a deflector, an extension, a recess) similar to those of the tracks 152, 154 shown in FIG. 2 to direct and rerail a toy vehicle, as well as to couple to one another.

Additionally, the support 306 includes a receptacle 308 configured to receive a portion of each ramped track 302, 304 to couple to the ramped tracks 302, 304. In the illustrated embodiment, the support 306 is a riser configured to raise a portion of each ramped track 302, 304. The support 306 may also be any other component configured to couple to at least a portion of each ramped track 302, 304. Additionally or alternatively, in certain embodiments, the support 306 is configured to couple to one of the ramped tracks 302, 304 and not the other of the ramped tracks 302, 304.

Figure 5B:
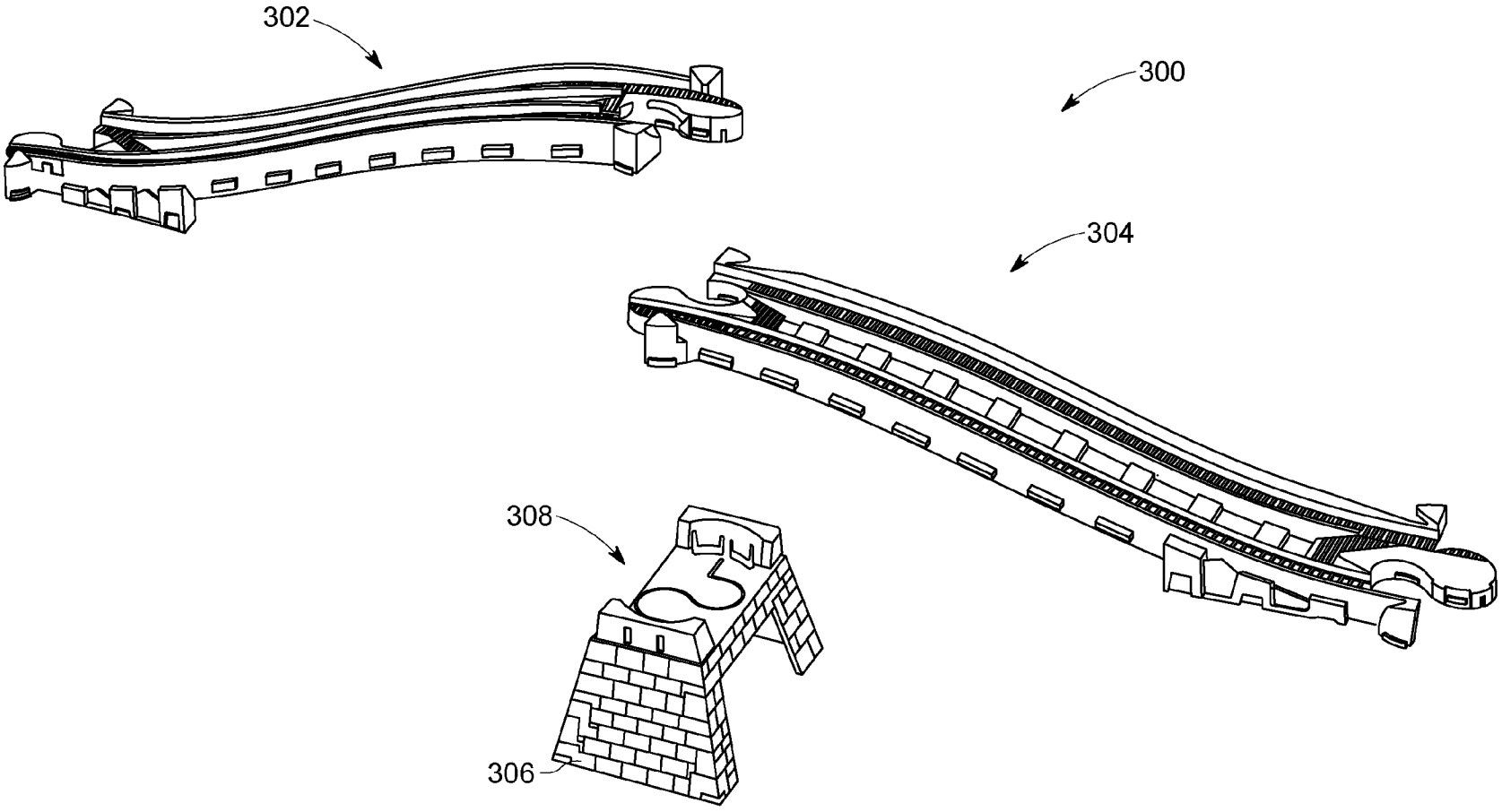
FIG. 5B illustrates a perspective view of the toy track assembly of FIG. 5A with the track pieces decoupled from the support and from one another.

FIG. 5B is a perspective view of the toy track assembly 300 in which the ramped tracks 302, 304 and the support 306 are not coupled to one another. That is, the ramped tracks 302, 304 and the support 306 are individual, separate pieces, such as prior to assembly by a user.

Figure 5C:
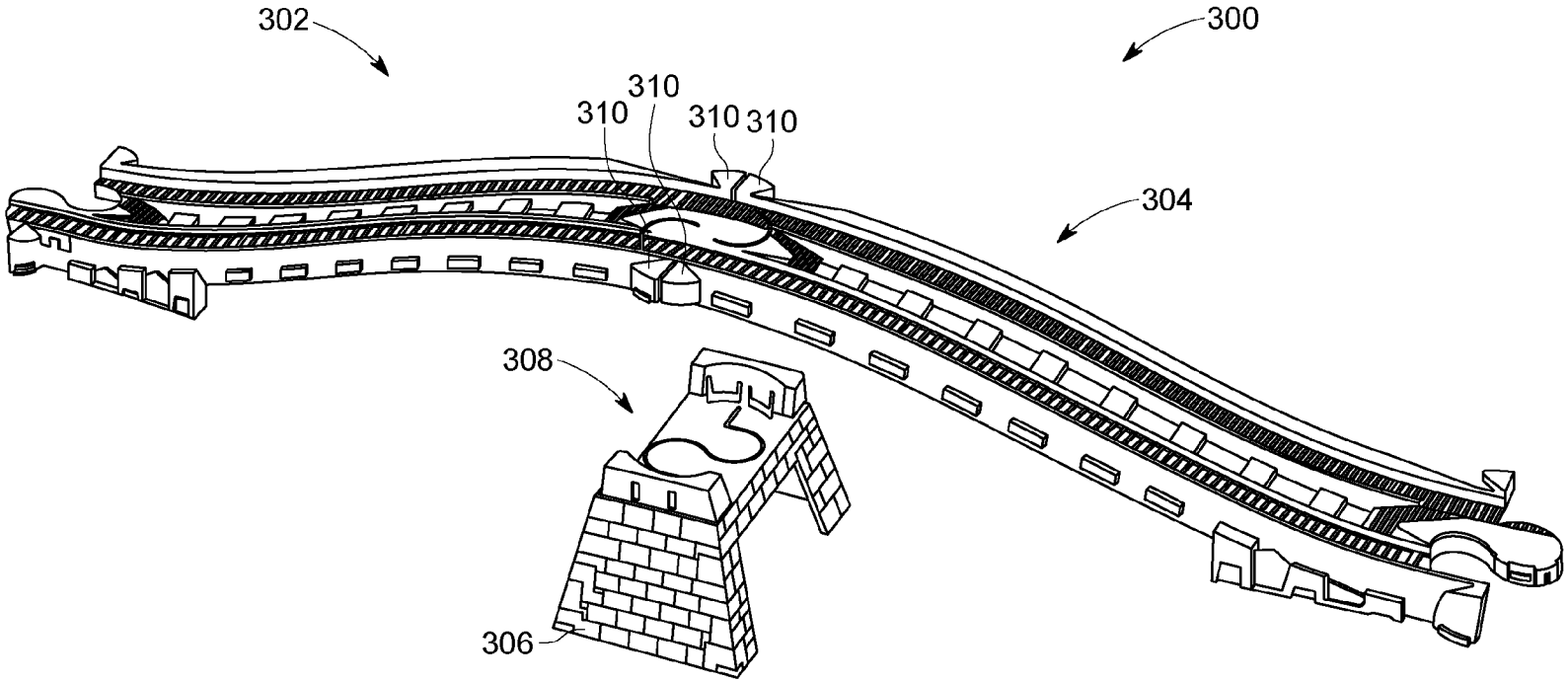
FIG. 5C illustrates a perspective view of the toy track assembly of FIGS. 5A and 5B with the track pieces coupled to one another but decoupled from the support.

FIG. 5C is a perspective view of the toy track assembly 300 in which the ramped tracks 302, 304 are coupled to one another but not coupled to the support 306. The illustrated embodiment represents a partially assembled configuration of the toy track assembly 300. Coupling the ramped tracks 302, 304 to one another positions respective tabs 310 of the ramped tracks 302, 304 against one another. The ramped tracks 302, 304 may then be inserted together into the receptacle 308 of the support 306 to engage each tab 310 with the support 306 in the receptacle 308, thereby simultaneously coupling both ramped tracks 302, 304 to the support 306.

The toy track assembly 300 may be assembled in any other suitable technique, such as by individually coupling the ramped tracks 302, 304 to the support 306. For example, the first ramped track 302 may be inserted into the receptacle 308 to engage its tabs 310 with the support 306 to couple to the support 306 while the second ramped track 304 remains exterior to the receptacle 308 and separate from the support 306. Afterwards, the second ramped track 304 is inserted into the receptacle 308 to place its tabs 310 against the tabs 310 of the first ramped track 302 and to engage its tabs 310 with the support 306 to couple to the first ramped track 302 and to the support 306.

The ramped tracks 302, 304 and the support 306 may also be decoupled from one another using a similar technique. As an example, the ramped tracks 302, 304 are simultaneously decoupled from the support 306 while remaining coupled to one another. After decoupling each ramped track 302, 304 from the support 306, the ramped tracks 302, 304 are decoupled from one another. As another example, one of the ramped tracks 302, 304 (e.g., the first ramped track 302) is initially decoupled from the support 306 and from the other of the ramped tracks 302, 304, and then the other of the ramped tracks 302, 304 is decoupled from the support 306. Thus, the toy track assembly 300 provides multiple different ways for assembly and disassembly thereof.

Figure 6:
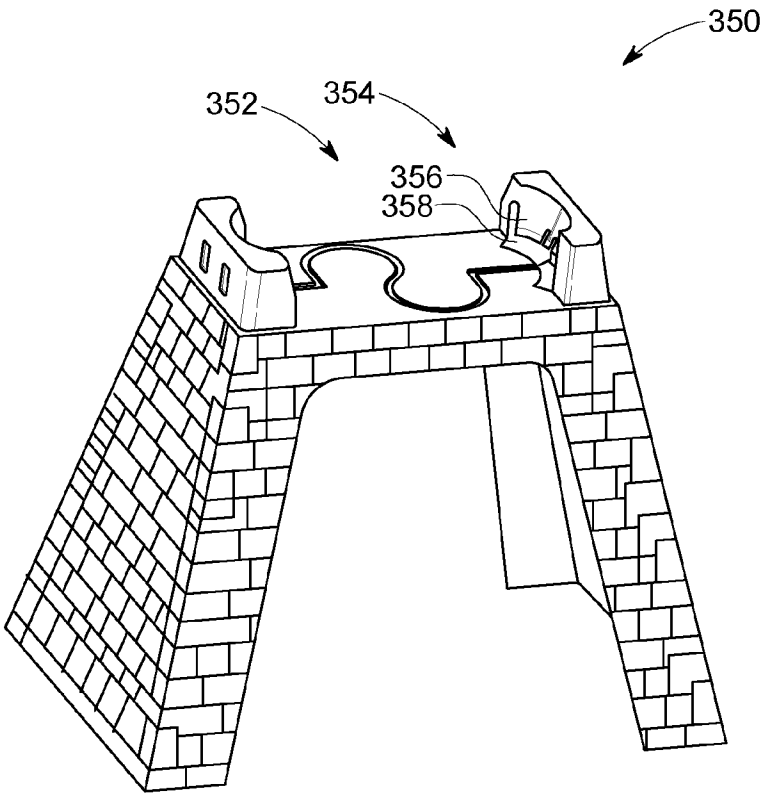
FIG. 6 illustrates a perspective view of a support of a toy track assembly, in accordance with an embodiment of the present application.

FIG. 6 is a perspective view of a support 350. The support 350 includes a receptacle 352 configured to receive and couple to a portion of a track. The support 350 includes a detent mechanism 354 that has a latch 356 extending over a groove 358. The groove 358 is configured to receive a tooth of one of the ramped tracks 302, 304 (e.g., extending from a tab of the track), and the latch 356 is configured to retain the tooth in the groove 358 to couple the track to the support 350. As described earlier, in one or more embodiments, the shape of a tab of a track is a circular sector and a semi-circular shape is formed when the tabs from two tracks are coupled together (see, e.g., FIG. 5A). Thus, the receptacle 352 of the support 350 includes a semi-circular shaped cutout to receive the correspondingly shaped tabs of the coupled ramped tracks 302, 304.

Figure 7:
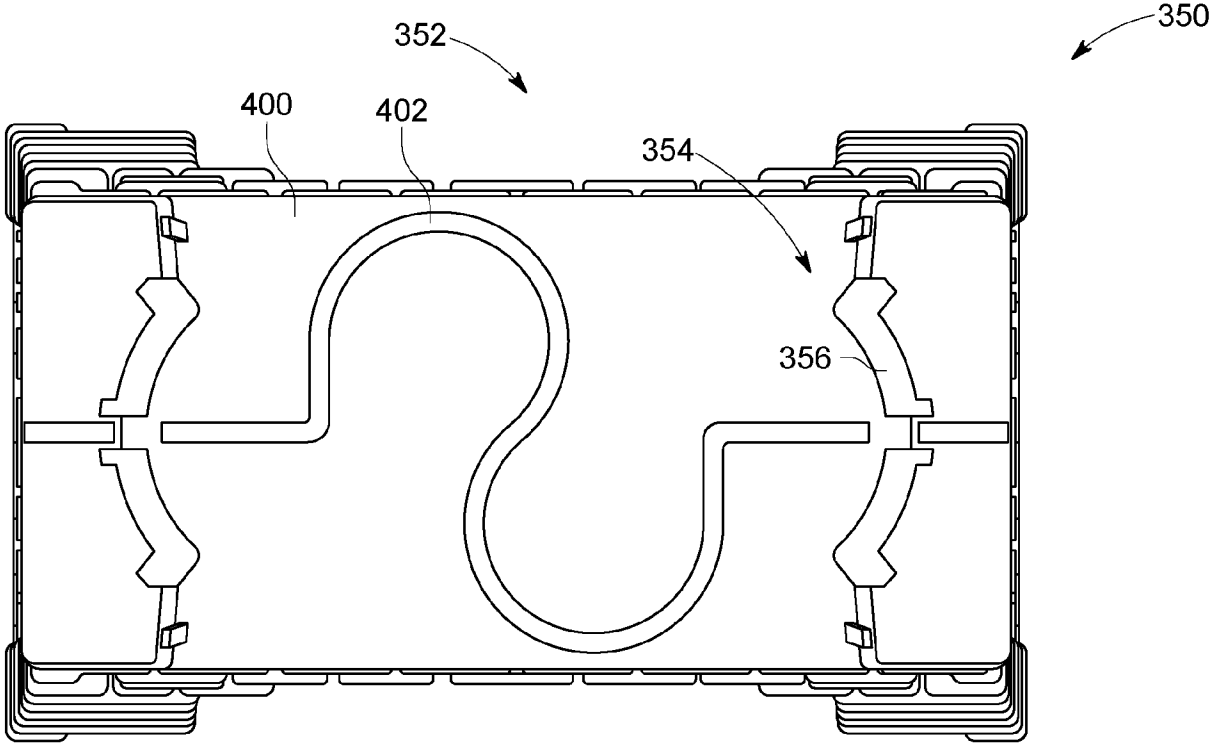
FIG. 7 illustrates a top view of the support of FIG. 6.

FIG. 7 is a top view of the support 350 providing additional visualization of the receptacle 352. The support 350 includes a surface 400 on which a track may be placed upon coupling to the support 350 (e.g., via the detent mechanism 354). Additionally, indicia 402 are formed on the surface 400. In particular, the indicia 402 provide an outline of an end of a track to indicate an orientation of the track for placement on the surface 400 to couple to the support 350.

By way of example, the indicia 402 may indicate a location/position of an extension and/or a recess of the track on the surface 400 for proper coupling to the support 350. Thus, the indicia 402 helps guide a user to couple the track to the support 350.

Figure 8:
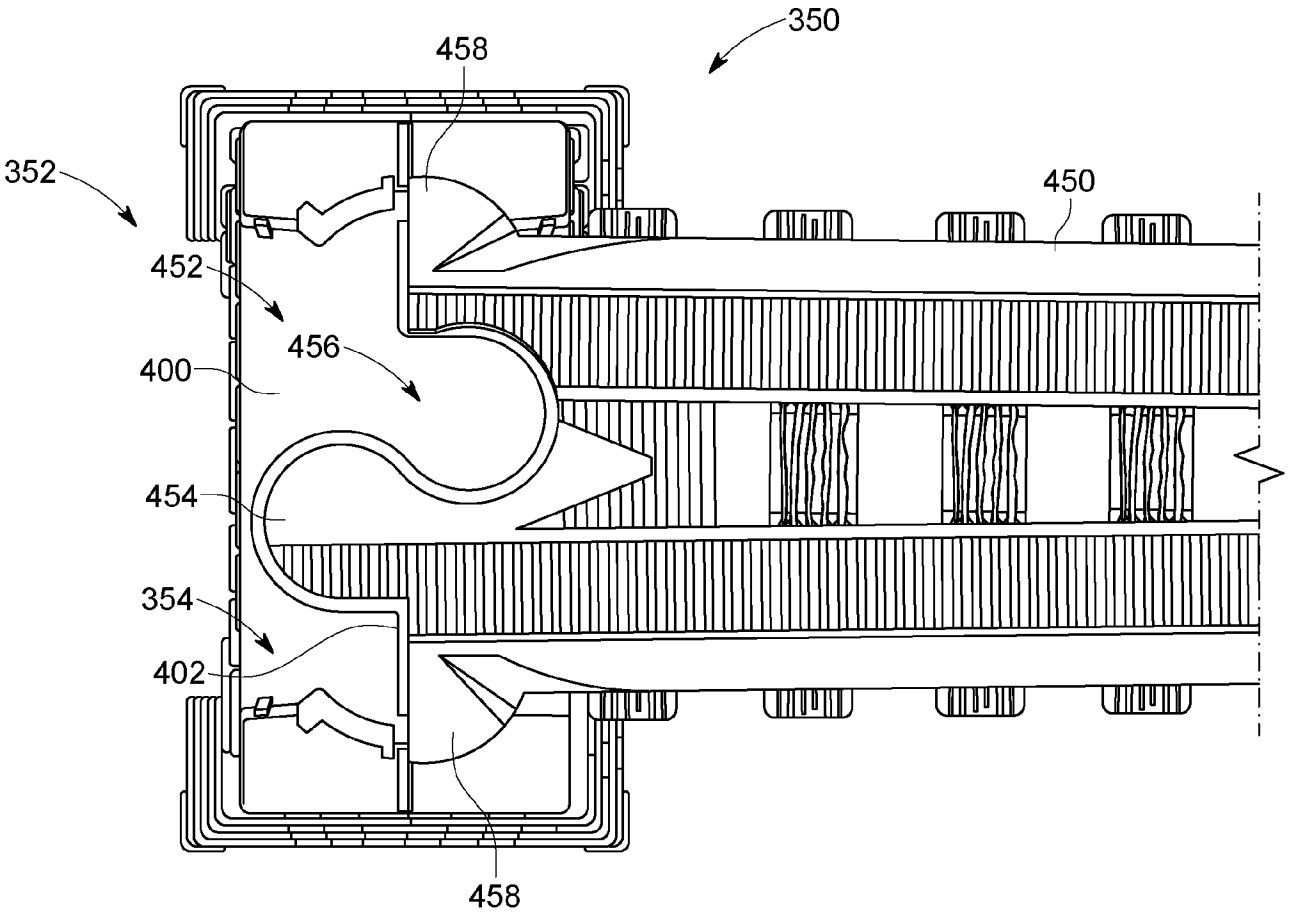
FIG. 8 illustrates a top view of a track piece coupled to the support of FIGS. 6 and 7, in accordance with an embodiment of the present application.

FIG. 8 is a top view of a track 450 coupled to the support 350. In particular, the track 450 is inserted into the receptacle 352 of the support 350. An end 452 of the track 450 includes an extension 454, a recess 456, and tabs 458 extending outward away from the extension 454 and the recess 456. The tabs 458 are configured to couple to the detent mechanism 354 of the support 350. For instance, teeth (not shown) extend from the tabs 458 and are inserted into respective grooves 358 (see FIG. 6) and held by corresponding latches 356 (see FIGS. 6 and 7). Coupling the track 450 to the support 350 places the end 452 of the track 450 in alignment with the indicia 402. In other words, the end 452 (e.g., the extension 454, the recess 456) of the track 450 follows along the indicia 402. Thus, the indicia 402 indicates proper placement of the track 450 within the receptacle 352 and on the surface 400 for coupling to the support 350.

Figure 9:
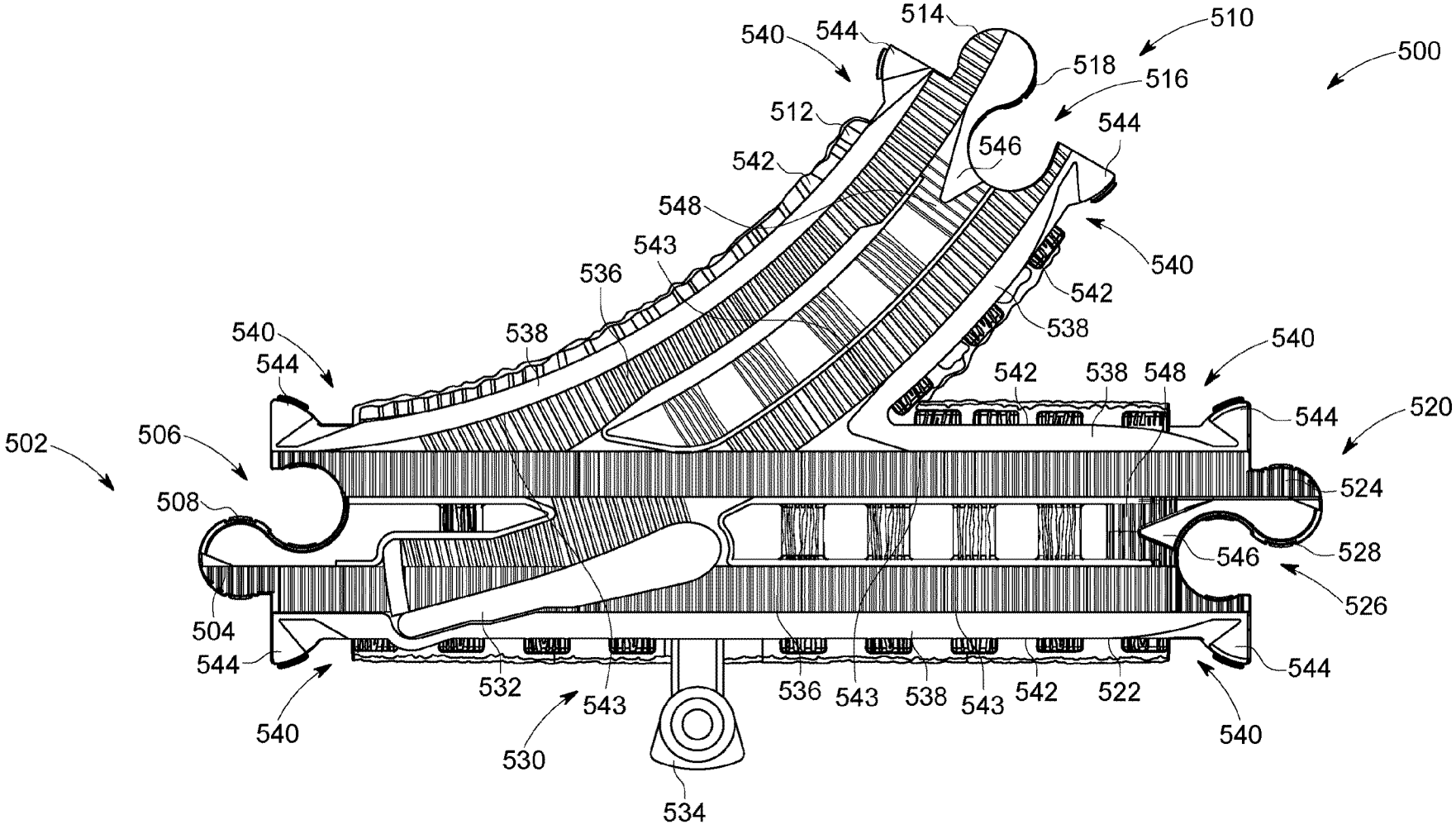
FIGS. 9-14 illustrate various configurations of track pieces with the features disclosed herein, in accordance with an embodiment of the present application.

FIGS. 9-14 illustrate various configurations of tracks with the features disclosed herein. FIG. 9 is a top view of a track 500 with track switching capabilities. A first end 502 of the track 500 includes a first extension 504 and a first recess 506 to couple the first end 502 of the track 500 to another track. The track 500 further includes first teeth 508 extending from the first extension 504 and/or within the first recess 506 to engage with teeth of the other track. A second end 510 of a first track segment 512 of the track 500 includes a second extension 514 and a second recess 516 to couple the second end 510 of the track 500 to another track. The track 500 also includes second teeth 518 extending from the second extension 514 and/or within the second recess 516 to engage with teeth of the other track. A third end 520 of a second track segment 522 of the track 500 includes a third extension 524 and a third recess 526. The track 500 includes third teeth 528 extending from the third extension 524 and/or within the third recess 526 to engage with teeth of the other track.

The track 500 includes a switching mechanism 530 configured to enable a toy vehicle to selectively travel along the first track segment 512 or along the second track segment 522. The illustrated switching mechanism 530 is positioned to enable the toy vehicle to travel between the first end 502 and the first track segment 512. In particular, the switching mechanism 530 includes a diverter 532 (e.g., a closure rail), which is positioned in the illustrated embodiment to guide wheels of the toy vehicle between the first end 502 and the first track segment 512. The diverter 532 is movable (e.g., via an interface 534) to be positioned in a manner that alternatively guides wheels of the toy vehicle between the first end 502 and the second track segment 522. Therefore, the diverter 532 is used to selectively control a travel path of the toy vehicle (e.g., along one of the first track segment 512 or the second extension 514).

Moreover, the track 500 includes wheel channels 536 extending between the first end 502 and the first track segment 512, as well as between the first end 502 and the second track segment 522. The track 500 further includes rails 538 extending along an exterior side/edge of each wheel channel 536. The wheel channels 536 are configured to receive the wheels of the toy vehicle, and the rails 538 encourage the wheels to remain within the wheel channels 536. Moreover, outer grooves 540 extend transversely from an exterior surface 542 of each rail 538, toward the wheel channels 536, and to an interior surface 543 of the rails 538. Each outer groove 540 is configured to guide a wheel into one of the wheel channels 536 if the wheel is positioned exteriorly of an exterior surface 542 to help rerail the toy vehicle. The track 500 also includes tabs 544 that extend outwardly away from the rails 538 to help rerail the toy vehicle by deflecting a wheel into a corresponding outer groove 540. The tabs 544 are also configured to couple the track 500 to another component (e.g., the support 350).

Furthermore, the track 500 includes deflectors 546 positioned interiorly of the wheel channels 536 to guide a wheel of the toy vehicle toward one of the wheel channels 536 if the wheel is interior of an interior side/edge of the wheel channel 536. Therefore, the deflectors 546 help rerail the toy vehicle as well. In some embodiments, the track 500 includes ramps 548 that each extend toward a deflector 546 to guide a wheel toward the deflector 628 for rerailing.

Figure 10:
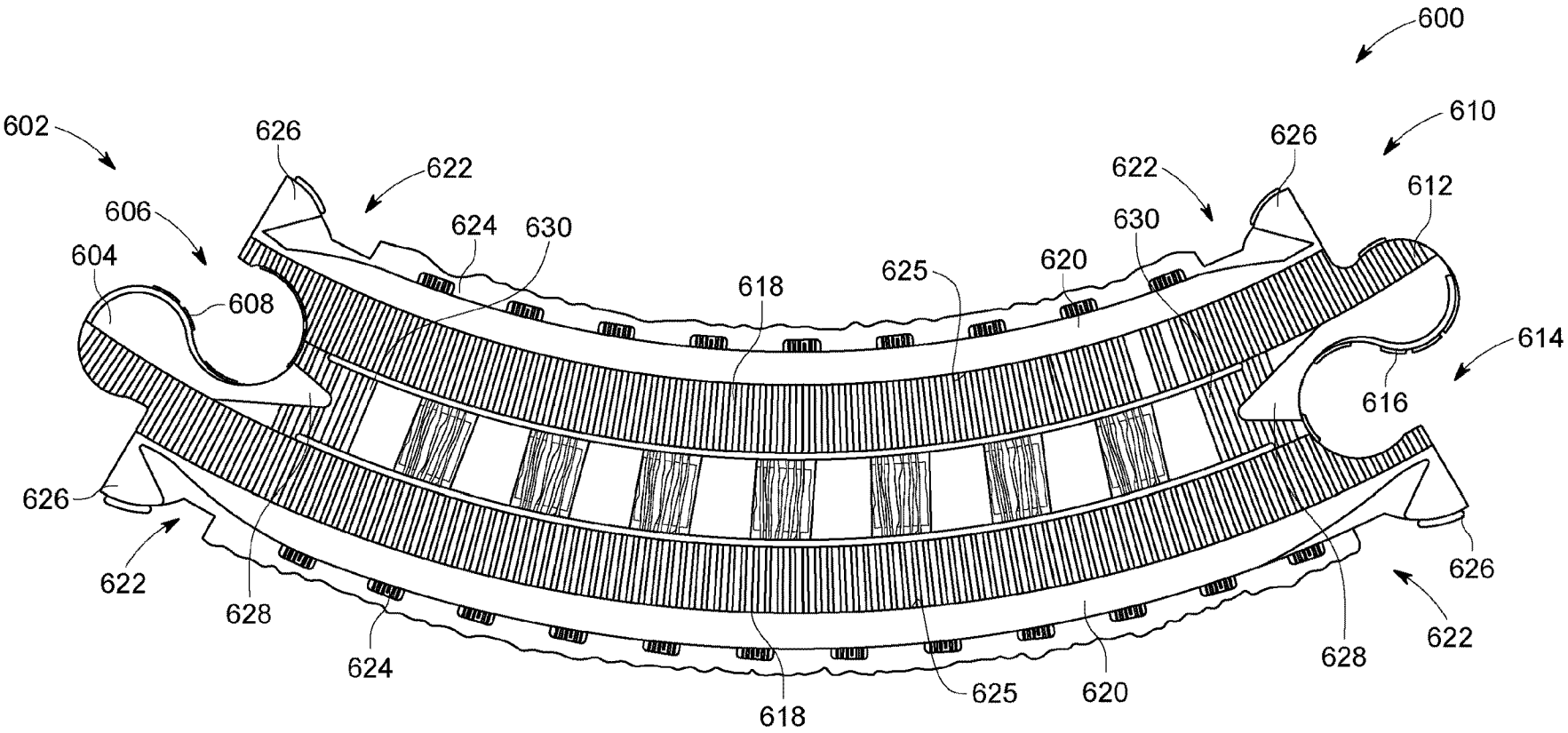

FIG. 10 is a top view of a track 600 that is curved. A first end 602 of the track 600 includes a first extension 604 and a first recess 606 to couple the first end 602 of the track 600 to another track. The track 600 includes first teeth 608 extending from the first extension 604 and/or within the first recess 606 to engage with the teeth of the other track. A second end 610, opposite the first end 602, of the track 600 includes a second extension 612 and a second recess 614 to couple the second end 610 to another track. The track 600 includes second teeth 616 extending from the second extension 612 and/or within the second recess 614 to engage with the teeth of the other track.

The track 600 further includes wheel channels 618 extending between the first end 602 and the second end 610, as well as rails 620 extending along an exterior side/edge of each wheel channel 618. The wheel channels 618 are configured to receive the wheels of the toy vehicle, and the rails 620 encourage the wheels to remain within the wheel channels 618. Outer grooves 622 extend transversely from an exterior surface 624 of each rail 620 facing away from the wheel channels 618, toward the wheel channels 618, and to an interior surface 625 of the rails 620 facing the wheel channels 618. Each outer groove 622 is configured to guide a wheel into one of the wheel channels 618 if the wheel is positioned exteriorly of the exterior surface 624 to help rerail the toy vehicle. The track 600 also includes tabs 626 that extend outwardly away from the rails 620 to help rerail the toy vehicle, such as by deflecting a wheel into a corresponding outer groove 622. The tabs 626 may also be configured to couple the track 600 to another component (e.g., the support 350).

The track 600 also includes deflectors 628 positioned interiorly of the wheel channels 618 to guide a wheel of the toy vehicle toward one of the wheel channels 618 if the wheel is interior of an interior side/edge of the wheel channel 618. Therefore, the deflectors 628 help rerail the toy vehicle. In some embodiments, the track 600 includes ramps 630 that each extend toward a deflector 628 to guide a wheel toward the deflector 628 for rerailing.

Figure 11:
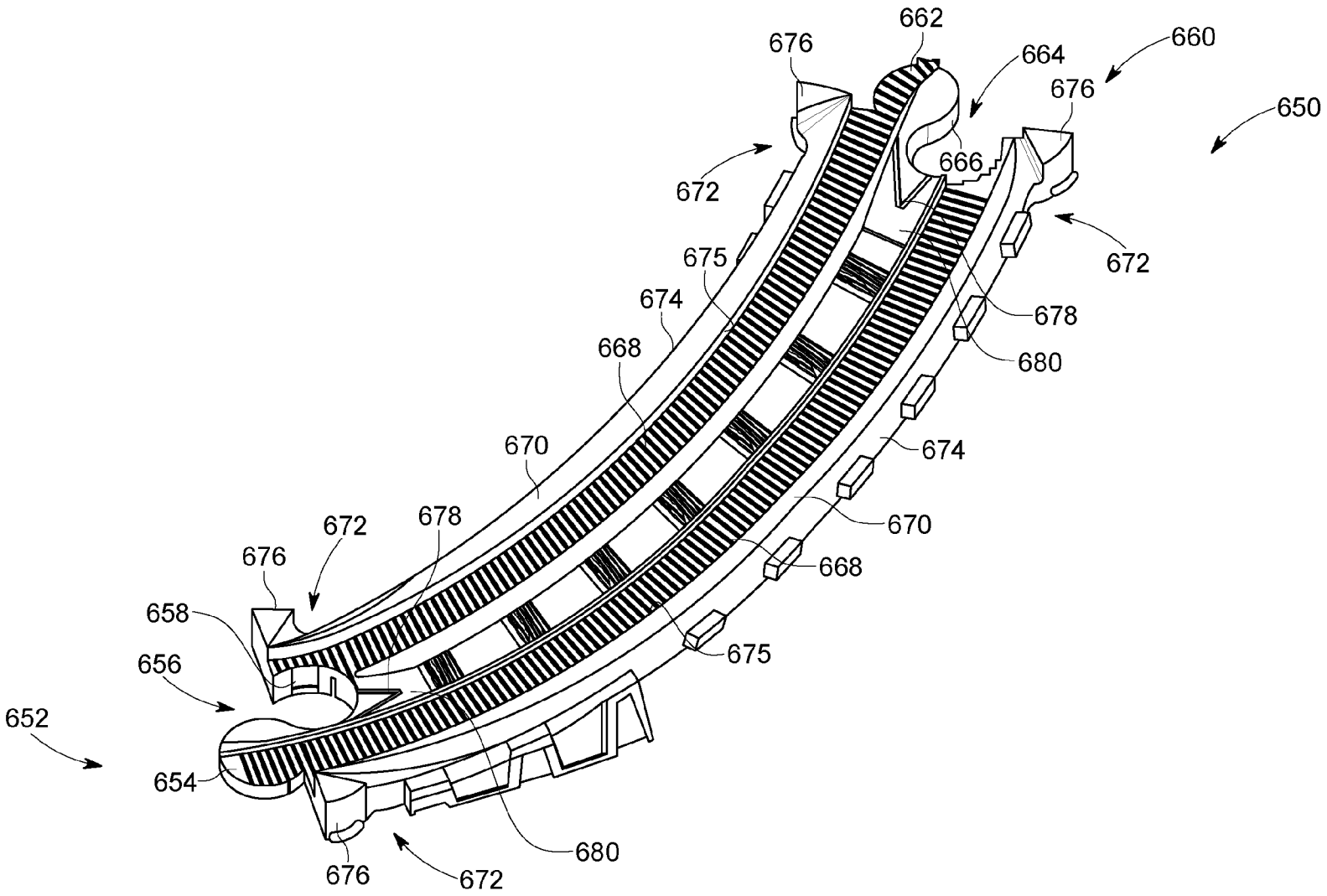

FIG. 11 is a side perspective view of a track 650 that is curved and changes elevation. A first end 652 of the track 650 includes a first extension 654 and a first recess 656 to couple the first end 652 of the track 650 to another track. The track 650 includes first teeth 658 extending from the first extension 654 and/or within the first recess 656 to engage with the teeth of the other track. A second end 660, opposite the first end 652, of the track 650 includes a second extension 662 and a second recess 664 to couple the second end 660 to another track. The track 650 includes second teeth 666 extending from the second extension 662 and/or within the second recess 664 to engage with the teeth of the other track.

The track 650 includes wheel channels 668 extending between the first end 652 and the second end 660, as well as rails 670 extending along an exterior side/edge of each wheel channel 668. The wheel channels 668 are configured to receive the wheels of the toy vehicle, and the rails 670 encourage the wheels to remain within the wheel channels 668. Outer grooves 672 extend transversely from an exterior surface 674 of each rail 670 facing away from the wheel channels 668, toward the wheel channels 668, and to an interior surface 675 of the rails 670 facing the wheel channels 668. Each outer groove 672 is configured to guide a wheel into one of the wheel channels 668 if the wheel is positioned exteriorly of the exterior surface 674 to help rerail the toy vehicle. The track 650 also includes tabs 676 extending outwardly away from the rails 670 to help rerail the toy vehicle, such as by deflecting a wheel into a corresponding outer groove 672. The tabs 676 may also be configured to couple the track 650 to another component (e.g., the support 350).

The track 650 further includes deflectors 678 positioned interiorly of the wheel channels 668 to guide a wheel of the toy vehicle toward one of the wheel channels 668 if the wheel is interior of an interior side/edge of the wheel channel 668. Therefore, the deflectors 678 help rerail the toy vehicle. In certain embodiments, the track 650 includes ramps 680 that each extend toward a deflector 678 to guide a wheel toward the deflector 678 for rerailing.

Figure 12:
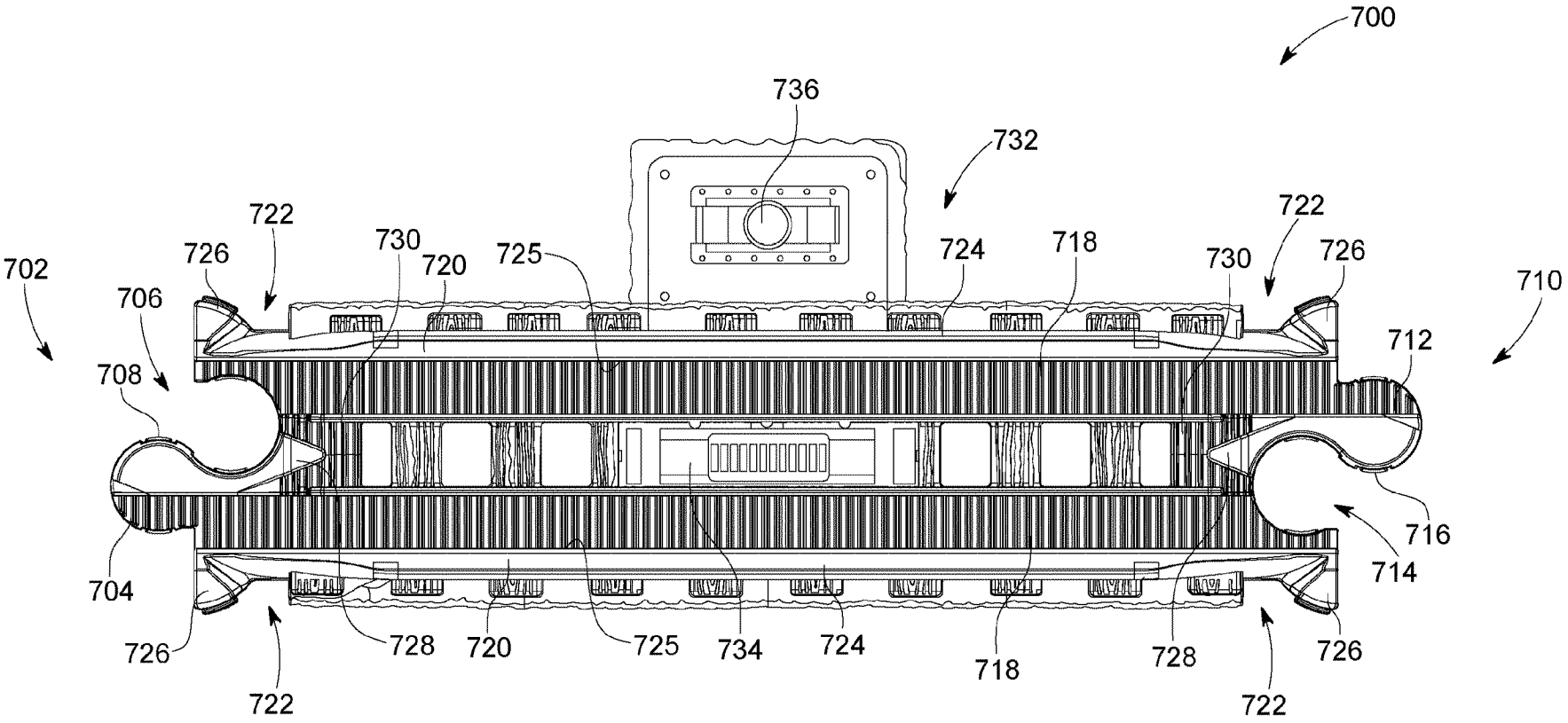

FIG. 12 is a top view of a track 700 that extends substantially straight and includes stopping capabilities. A first end 702 of the track 700 includes a first extension 704 and a first recess 706 to couple the first end 702 of the track 700 to another track. The track 700 includes first teeth 708 extending from the first extension 704 and/or within the first recess 706 to engage with the teeth of the other track. A second end 710, opposite the first end 702, of the track 700 includes a second extension 712 and a second recess 714 to couple the second end 710 to another track. The track 700 includes second teeth 716 extending from the first end 702 and/or within the second recess 714 to engage with the teeth of the other track.

The track 700 includes wheel channels 718 extending between the first end 702 and the second end 710, as well as rails 720 extending along an exterior side/edge of each wheel channel 718. The wheel channels 718 are configured to receive the wheels of the toy vehicle, and the rails 720 encourage the wheels to remain within the wheel channels 718. Outer grooves 722 extend transversely from an exterior surface 724 of each rail 720 facing away from the wheel channels 718, toward the wheel channels 718, and to an interior surface 725 of the rails 720 facing the wheel channels 718. Each outer groove 722 is configured to guide a wheel into one of the wheel channels 718 if the wheel is positioned exteriorly of the exterior surface 724 to help rerail the toy vehicle. The track 700 also includes tabs 726 extending outwardly away from the rails 720 to help rerail the toy vehicle, such as by deflecting a wheel into a corresponding outer groove. The tabs 726 are configured to couple the track 700 to another component (e.g., the support 350).

The track 700 further includes deflectors 728 positioned interiorly of the wheel channels 718 to guide a wheel of the toy vehicle toward one of the wheel channels 718 if the wheel is interior of an interior side/edge of the wheel channel 718. Therefore, the deflectors 728 help rerail the toy vehicle. In certain embodiments, the track 700 includes ramps 730 that each extend toward a deflector 728 to guide a wheel toward the deflector 728 for rerailing.

The track 700 includes a stopping mechanism 732 configured to block a toy vehicle from moving along the track 700. To this end, the stopping mechanism 732 includes a stopper 734 configured to move between a first position and a second position. In the first position, the stopper 734 is positioned such that the stopper 734 is clear of the toy vehicle while the toy vehicle is traveling over the stopper 734. Consequently, the toy vehicle is able to travel along the track 700 unhindered by the stopper 734. However, in the second position, the stopper 734 is positioned (e.g., extends farther above the wheel channels 718) to abut a toy vehicle (e.g., a chassis of the toy vehicle) moving along the track 700, thereby hindering the toy vehicle from advancing further along the track 700. In some embodiments, an interface 736 (e.g., a lever) is used to transition the stopper 734 between the first position and the second position.

Figure 13:
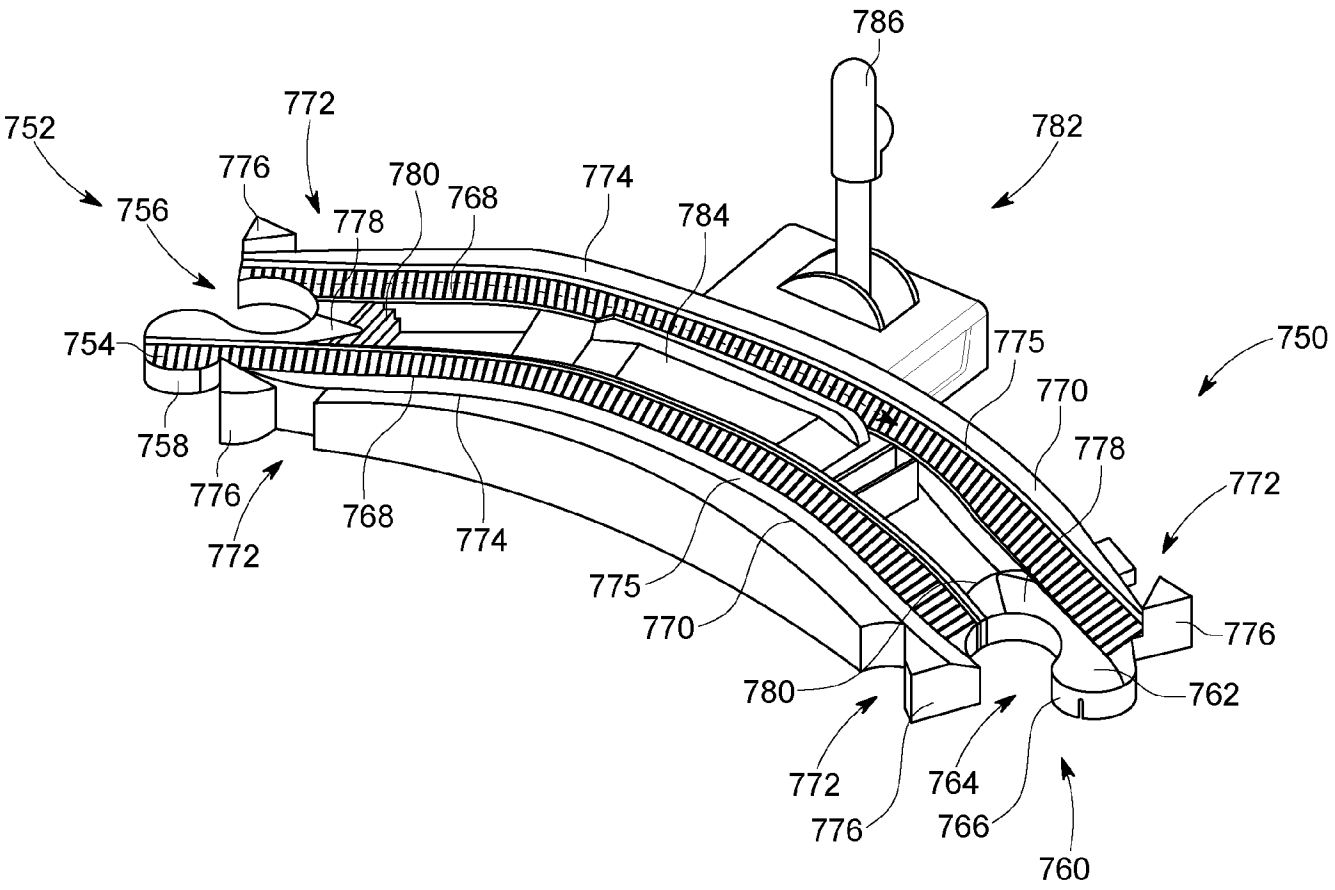

FIG. 13 is a perspective view of a track 750 that is curved and includes stopping capabilities. A first end 752 of the track 750 includes a first extension 754 and a first recess 756 to couple the first end 752 of the track 750 to another track. The track 750 includes first teeth 758 extending from the first extension 754 and/or within the first recess 756 to engage with the teeth of the other track. A second end 760, opposite the first end 752, of the track 750 includes a second extension 762 and a second recess 764 to couple the second end 760 to another track. The track 750 includes second teeth 766 extending from the first end 752 and/or within the second recess 764 to engage with the teeth of the other track.

The track 750 includes wheel channels 768 extending between the first end 752 and the second end 760, as well as rails 770 extending along an exterior side/edge of each wheel channel 768. The wheel channels 768 are configured to receive the wheels of the toy vehicle, and the rails 770 encourage the wheels to remain within the wheel channels 768. Outer grooves 772 extend transversely from an exterior surface 774 of each rail 770 facing away from the wheel channels 768, toward the wheel channels 768, to an interior surface 775 of the rails 770 facing the wheel channels 768. Each outer groove 772 is configured to guide a wheel into one of the wheel channels 768 if the wheel is positioned exteriorly of the exterior surface 774 to help rerail the toy vehicle. The track 750 also includes tabs 776 extending outwardly away from the rails 770 to help rerail the toy vehicle, such as by deflecting a wheel into a corresponding outer groove 772. The tabs 776 are also configured to couple the track 750 to another component (e.g., the support 350). The track 750 further includes deflectors 778 positioned interiorly of the wheel channels 768 to guide a wheel of the toy vehicle toward one of the wheel channels 768 if the wheel is interior of an interior side/edge of the wheel channel 768. Therefore, the deflectors 778 help rerail the toy vehicle. In certain embodiments, the track 700 includes ramps 780 that each extend toward a deflector 778 to guide a wheel toward the deflector 778 for rerailing.

The track 750 includes a stopping mechanism 782 configured to block a toy vehicle from moving along the track 750. To this end, the stopping mechanism 782 includes a stopper 784 configured to move between a first position and a second position. In the first position, the stopper 784 is positioned such that the stopper 784 is clear of the toy vehicle while the toy vehicle is traveling over the stopper 784. Consequently, the toy vehicle is able to travel along the track 750 unhindered by the stopper 784. However, in the second position, the stopper 784 is positioned (e.g., extends farther above the wheel channels 768) to abut a toy vehicle (e.g., a chassis of the toy vehicle) moving along the track 750, thereby hindering the toy vehicle from advancing further along the track 750. In some embodiments, an interface 786 (e.g., a lever) is used to transition the stopper 784 between the first position and the second position.

Figure 14:
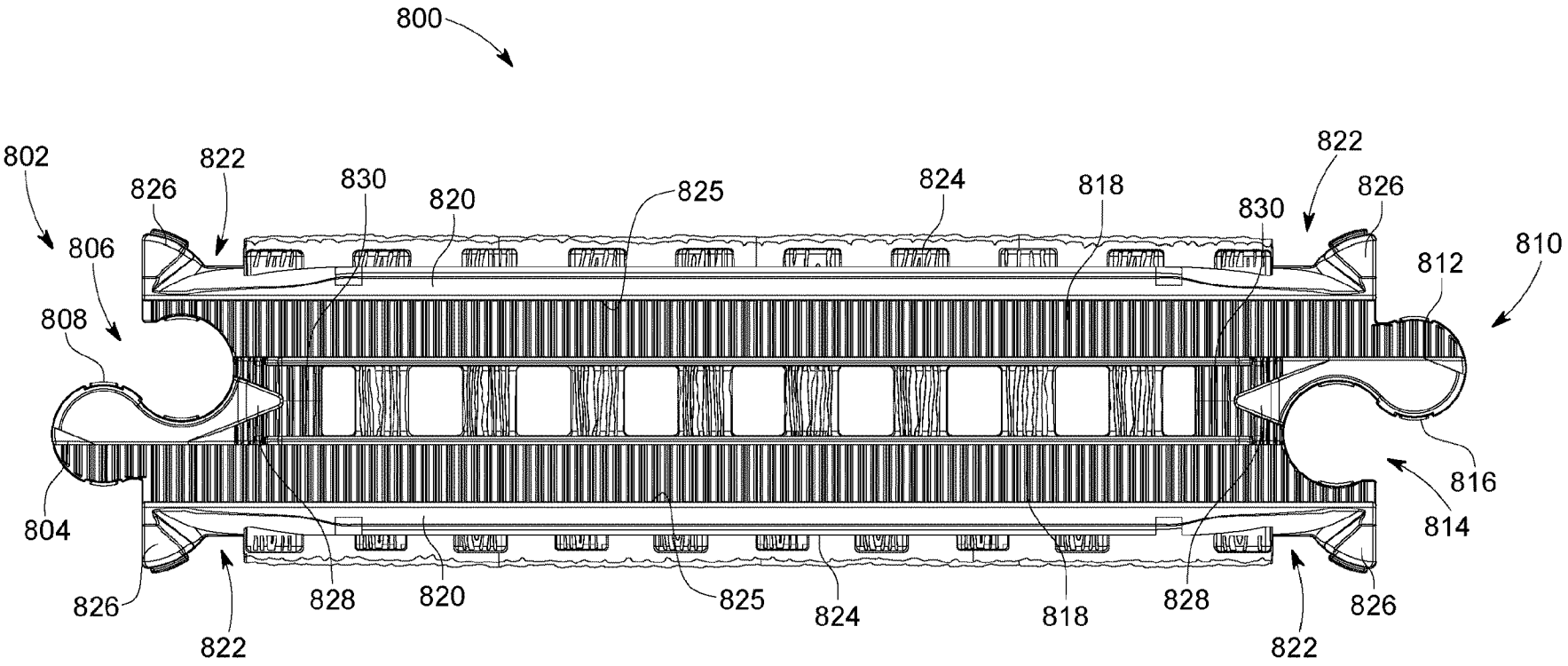

FIG. 14 is a top view of a track 800 that is substantially straight. A first end 802 of the track 800 includes a first extension 804 and a first recess 806 to couple the first end 802 of the track 800 to another track. The track 800 includes first teeth 808 extending from the first extension 804 and/or within the first recess 806 to engage with the teeth of the other track. A second end 810, opposite the first end 802, of the track 800 includes a second extension 812 and a second recess 814 to couple the second end 810 to another track. The track 800 includes second teeth 816 extending from the second extension 812 and/or within the second recess 814 to engage with the teeth of the other track.

The track 800 further includes wheel channels 818 extending between the first end 802 and the second end 810, as well as rails 820 extending along an exterior side/edge of each wheel channel 818. The wheel channels 818 are configured to receive the wheels of the toy vehicle, and the rails 820 encourage the wheels to remain within the wheel channels 818. Outer grooves 822 extend transversely from an exterior surface 824 of each rail 820 facing away from the wheel channels 818, toward the wheel channels 818, and to an interior surface 825 of the rails 820 facing the wheel channels 818. Each outer groove 822 is configured to guide a wheel into one of the wheel channels 818 if the wheel is positioned exteriorly of the exterior surface 824 to help rerail the toy vehicle. The track 800 also includes tabs 826 that extend outwardly away from the rails 820 to help rerail the toy vehicle, such as by deflecting a wheel into a corresponding outer groove 822. The tabs 826 are also configured to couple the track 800 to another component (e.g., the support 350). The track 800 does not include features (e.g., a stopper, a diverter) that affect how a toy vehicle travels along the wheel channels 818.

The track 800 also includes deflectors 828 positioned interiorly of the wheel channels 818 to guide a wheel of the toy vehicle toward one of the wheel channels 818 if the wheel is interior of an interior side/edge of the wheel channel 818. Therefore, the deflectors 828 help rerail the toy vehicle. In some embodiments, the track 800 includes ramps 830 that each extend toward a deflector 828 to guide a wheel toward the deflector 828 for rerailing.

In some implementations, a toy track assembly (e.g., the toy track assembly 102) may employ multiple different tracks, such as any of the tracks 500, 600, 650, 700, 750, 800, that have rerailing features (e.g., outer grooves, tabs, deflectors). Such tracks are configured to couple to one another in various arrangements such that the toy track assembly is modular. Regardless of the arrangement of tracks, the assembled toy track assembly includes multiple rerailing features positioned at various locations. As a result, a derailed toy vehicle traveling along the toy track assembly may travel a limited distance (e.g., less than a length of a track) before encountering a rerailing feature to be rerailed. Therefore, the toy track assembly enables the train to be more readily rerailed, which enhances its entertainment value.

The tracks of a toy track assembly disclosed herein include features to rerail a toy vehicle. Thus, the tracks enable the toy vehicle to travel desirably along the track assembly. The tracks also include features to help ease coupling and decoupling relative to one another, which enables the track assembly to be assembled and/or disassembled more easily.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present disclosure to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the disclosure.

Although the disclosed examples are illustrated and described herein as embodied in one or more specific examples, it is nevertheless not intended to be limited to the details shown, since various modifications and structural changes may be made therein without departing from the scope of the disclosure and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A toy track assembly, comprising:

a track comprising:

a wheel channel extending along a length of the track and configured to receive a wheel of a toy vehicle to direct the toy vehicle along the length of the track;

a rail extending along an exterior side of the wheel channel and configured to encourage the wheel of the toy vehicle to remain within the wheel channel; and an outer groove extending transversely from an exterior surface of the rail, through the rail, and toward the wheel channel to guide the wheel of the toy vehicle from the exterior surface of the rail into the wheel channel if the wheel is exterior to the exterior surface of the rail.

2. The toy track assembly of claim 1, wherein the track comprises a deflector disposed interiorly of an interior side of the wheel channel, wherein a surface of the deflector is configured to guide the wheel of the toy vehicle from the interior side of the wheel channel into the wheel channel if the wheel is interior of the interior side of the wheel channel.

3. The toy track assembly of claim 2, wherein the surface of the deflector and the outer groove extend toward one another.

4. The toy track assembly of claim 2, wherein the track comprises a ramp extending toward the deflector to guide the wheel toward the surface of the deflector.

5. The toy track assembly of claim 1, wherein an end of the track comprises an extension, and the toy track assembly comprises an additional track having a recess configured to receive the extension to couple the track and the additional track to one another.

6. The toy track assembly of claim 5, wherein the extension of the track comprises a first tooth forming a first detent mechanism, the additional track comprises a second tooth forming a second detent mechanism, and the first detent mechanism is configured to interface with the second detent mechanism to couple the track and the additional track to one another.

7. The toy track assembly of claim 5, wherein the end of the track comprises a tab extending outwardly away from the rail, and the toy track assembly comprises a support configured to receive the tab to couple the track and the support to one another.

8. The toy track assembly of claim 7, wherein the outer groove extends between the rail and the tab.

9. The toy track assembly of claim 5, wherein the additional track comprises an additional extension, and the track comprises an additional recess configured to receive the additional extension to couple the track and the additional track to one another.

10. A track for a toy assembly, the track comprising:

a channel configured to receive a wheel of a toy vehicle of the toy assembly to direct the toy vehicle along a length of the track;

a rail comprising an interior surface facing the channel and an exterior surface facing away from the channel; and a tab at an end of the track, wherein the tab extends outwardly from the rail along an axis perpendicular to the channel, the tab comprises an end side extending along the axis and an exterior side extending from the end side and facing away from the channel, and the tab comprises a tooth extending from the exterior side and configured to engage with a support of the toy assembly to couple the track to the support.

11. The track of claim 10, further comprising:

a groove extending transversely from the exterior surface of the rail to the interior surface of the rail toward the channel, the groove being configured to direct the wheel back into the channel if the wheel is exterior to the exterior surface of the rail; and a deflector disposed interiorly of an interior side of the channel, wherein the deflector is configured to guide the wheel back into the channel if the wheel is interior to the interior side of the channel.

12. The track of claim 11, wherein the tab is configured to deflect the wheel into the groove if the wheel is exterior to the exterior surface of the rail.

13. The track of claim 10, comprising a recess at the end of the track and an additional tooth extending into the recess and configured to engage with an additional track of the toy assembly to couple the track to the additional track.

14. The track of claim 10, wherein the exterior side of the tab includes a curved side, and the tooth extends from the curved side of the tab.

15. The track of claim 10, comprising:

an additional channel configured to receive an additional wheel of the toy vehicle to direct the toy vehicle along the length of the track;

an additional rail comprising an additional interior surface facing the channel and an additional exterior surface facing away from the additional channel; and a groove extending through the additional rail toward the additional channel.

16. A track for a toy assembly, the track comprising:

a channel configured to receive a wheel of a toy vehicle to direct the toy vehicle along a length of the track;

a rail extending along an exterior side of the channel and configured to encourage the wheel of the toy vehicle to remain within the channel;

a groove extending through the rail to direct the wheel of the toy vehicle back into the channel if the wheel is exterior to the rail; and a deflector disposed interiorly of an interior side of the channel and configured to guide the wheel of the toy vehicle back into the channel if the wheel is interior to the channel.

17. The track of claim 16, comprising an additional channel configured to receive an additional wheel of the toy vehicle to direct the toy vehicle along the length of the track, wherein the deflector is disposed between the channel and the additional channel.

18. The track of claim 16, comprising an extension configured to extend into a recess of an additional track to couple the track to the additional track, wherein the deflector extends to the extension.

19. The track of claim 16, comprising a recess configured to receive an extension of an additional track to couple the track to the additional track, wherein the deflector extends around the recess.

20. The track of claim 16, wherein the groove extends through the rail at a first end of the track, and the track comprises an additional groove extending through the rail to direct the wheel of the toy vehicle back into the channel if the wheel is exterior to the rail, the additional groove extending through the rail at a second end, opposite the first end, of the track.

* * * * *